US005102778A

United States Patent [19]

Nakamura

[11] Patent Number: 5,102,778

[45] Date of Patent: Apr. 7, 1992

[54] METHOD FOR PROCESSING SILVER HALIDE COLOR PHOTOGRAPHIC MATERIAL

[75] Inventor: Koichi Nakamura, Kanagawa, Japan

[73] Assignee: Fuji Photo Film Co., Ltd., Kanagawa, Japan

[21] Appl. No.: 610,901

[22] Filed: Nov. 9, 1990

[30] Foreign Application Priority Data

Nov. 13, 1989 [JP] Japan ..... 1-294344

[51] Int. Cl.[5] ..... G03C 7/30; G03C 7/42

[52] U.S. Cl. ..... 430/393; 430/383; 430/430; 430/442; 430/460; 430/484; 430/963

[58] Field of Search ..... 430/383, 393, 430, 460, 430/467, 464, 963, 442, 484

[56] References Cited

U.S. PATENT DOCUMENTS

| | | | |
|---|---|---|---|
| 4,297,437 | 10/1981 | Kaneko et al. | 430/399 |
| 4,818,673 | 4/1989 | Ueda et al. | 430/566 |
| 4,837,140 | 6/1990 | Ikeda et al. | 430/550 |
| 4,894,319 | 1/1990 | Ikeda et al. | 430/383 |
| 4,925,778 | 6/1990 | Wiernicke et al. | 430/383 |
| 4,962,014 | 10/1990 | Ishikawa et al. | 430/393 |
| 4,966,834 | 4/1990 | Ishikawa et al. | 430/393 |

FOREIGN PATENT DOCUMENTS

| | | | |
|---|---|---|---|
| 46461 | 2/1988 | Japan | 430/460 |
| 124571 | 5/1990 | Japan | 430/460 |

*Primary Examiner*—Hoa Van Le

*Attorney, Agent, or Firm*—Sughrue, Mion, Zinn, Macpeak & Seas

[57] ABSTRACT

A method for processing a silver halide light-sensitive material comprising subjecting an imagewise exposed silver halide color light-sensitive material having a silver chloride content substantially of 90 mol % or more to color developement in a color developing solution containing a hydrophilic p-phenylenediamine derivative and substantially no benzyl alcohol at a temperature of 30° C. or higher for a period of 15 seconds or less and then subjecting the color developed material to bleach or bleach-fix, wherein the color development processed silver halide color light-sensitive material is introduced into a bleaching or bleach-fix bath with the amount of a color developing agent in the film of the light-sensitive material being controlled to 0.8 mmol/m$^2$ or less, and wherein the desilvering is completed within 30 seconds. According to the process, not only color development but also desilvering can be completed in a reduced time without desilvering insufficiently, and a dye image having long-term preservation stability can be obtained.

9 Claims, No Drawings

METHOD FOR PROCESSING SILVER HALIDE COLOR PHOTOGRAPHIC MATERIAL

FIELD OF THE INVENTION

This invention relates to a method for rapidly and stably processing a color light-sensitive material containing light-sensitive silver halide and couplers, such as a color paper. More particularly, it relates to a method for processing a color photographic material which makes it feasible to achieve image formation and desilvering in a reduced processing time. It also relates to a method for processing a color photographic material which provides a color image excellent in dye image stability.

BACKGROUND OF THE INVENTION

Photographic processing of silver halide color photographic materials basically comprises development (in the case of color reversal materials, color development is preceded by black-and-white first development), desilvering, and washing. Desilvering comprises bleach and fixing or combined bleach-fix (blix). Processing further includes supplementary steps, such as stabilization, prebath processing preceding each step, and stopping. In color development, exposed silver halide is reduced by a color developing agent to form silver and halogen ions. Simultaneously, the thus oxidized color developing agent reacts with a coupler to form a dye. Therefore, because a large quantity of a silver halide color photographic material is continuously processed, halogen ion accumulate in the developing solution.

Recently, reduction in the rate of replenishment for the purpose of saving resources and reduction of environmental pollution has been extensively studied. However, mere reduction of replenishment of a developing solution gives rise to a problem that substances dissolved from a light-sensitive material, particularly iodide ion or bromide ion which are each strong development inhibitors, accumulate and lessen development activity. This results in a decrease in processing rapidity. In order to reduce the accumulation of iodide or bromide ion, use of a silver halide light-sensitive material having a high silver chloride content to thereby secure rapid processing as disclosed in JP-A-58-95345, JP-A-59-232342, JP-A-61-70552, W087-04534, and JP-A-1-105948 (the term "JP-A" as used herein means an "unexamined published Japanese patent application") has been proposed. Use of such a high silver chloride light-sensitive material is considered an effective means for making rapid development processing feasible. While a shortening of color development time has thus been steadily realized, the time required for bleach-fix subsequent to color development has not changed so that the overall processing time has not been greatly reduced.

JP-A-1-196044 discloses a processing method in which color development is completed in 25 seconds or less, and the overall processing time including the times for bleach-fix and washing is within 2 minutes. In this method, however, light-sensitive materials are not sufficiently desilvered when continuously processed due to such a short time for bleach-fix. Thus an image of clear color separation is not obtained. Further, it turned out that when bleach-fix is completed within a very short time of 30 seconds or less, the resulting image is stained with time, particularly under light irradiation at high humidity.

Reduction in overall processing time of color photographic materials is a present day object that one skilled in the art has been eager to accomplish. Namely, greatly speeding up each step involved from color development through drying is required. Under the present situation, however, if color development and bleach-fix is each effected in an extremely short time, continuous processing is easily accompanied by desilvering insufficiency, and the resulting dye image has deteriorated preservability.

SUMMARY OF THE INVENTION

An object of the present invention is to provide a method for processing a color photographic light-sensitive material which achieves ultra-rapid development and also makes it possible to reduce the time required for the subsequent bleach-fix and washing.

Another object of the present invention is to provide a method for processing a color photographic material which provides a dye image having excellent long-term preservation stability even when bleach-fix is completed in a short time.

Research has been conducted on ultra-rapid processing of a light-sensitive material comprising silver halide having a high silver chloride content by appropriately selecting a p-phenylenediamine derivative and/or by changing the film thickness and the degree of swelling of the light-sensitive material. As a result, it has been unexpectedly found that rapid processing can be achieved in all of the steps including color development, bleach-fix, and washing, and an image excellent with long-term preservation stability can be obtained even through rapid desilvering and rapid washing. This is achieved by subjecting a high silver chloride light-sensitive material to color development with a hydrophilic p-phenylenediamine derivative as a developing agent and then passing this material to a bleaching or bleach-fix bath with the amount of the color developing agent present in the light-sensitive material being controlled below a certain level.

That is, the above objects of the present invention are accomplished by a method for processing a silver halide color photographic light-sensitive material comprising subjecting an imagewise exposed silver halide color light-sensitive material having a silver chloride content substantially of 90 mol % or more to color development and then subjecting the color developed material to bleach or bleach-fix, wherein the color development is effected with a color developing solution containing a hydrophilic p-phenylenediamine derivative and substantially no benzyl alcohol at a temperature of 30° C. or higher for a period of 20 seconds or less, and wherein the method comprises introducing the color development processed silver halide color light-sensitive material into a bleaching or bleach-fix bath with the amount of a color developing agent in the film of the light-sensitive material being controlled to 1 mmol/$m^2$ or less, preferably 0.8 mmol/$m^2$ or less, and more preferably 0.6 mmol/$m^2$ or less but 0.3 mmol/$m^2$ or more, and desilvering is completed within 30 seconds, and preferably within 20 seconds.

In the present invention, the color developing solution also preferably contains substantially no hydroxylamine and/or no sulfite ion. The color developing agent which can be used in the present invention has at least one hydrophilic group and preferably has a calculated logP value (hereinafter defined) of not more than 1.0.

The amount of color developing solution replenisher is preferably not more than 120 ml, and more preferably from 15 to 60 ml, per $m^2$ of the light-sensitive material. The amount of replenisher of a bleach-fix solution, a washing solution or a stabilizing solution is preferably not more than 3 times the amount of the carry-over from the respective preceding bath.

The terminology "developing time" as used herein means the time during which a light-sensitive material is retained in a developing solution.

The terminology "substantially no benzyl alcohol" as used herein means that benzyl alcohol is not present in as a large a quantity as has been conventionally used. Taking the objects of the present invention into consideration, a suitable concentration of benzyl alcohol in the developing solution is not more than 8 ml/l, preferably not more than 5 ml/l, and more preferably from 0 up to 3 ml/l. The presence of a small amount of benzyl alcohol in a developing solution is sometimes favorable for achieving ultra-rapid processing.

DETAILED DESCRIPTION OF THE INVENTION

In general, the rate of color development varies depending on the kind of p-phenylenediamine derivative used as a color developing agent. A color developing agent having a hydrophobic group as an N-substituent, such as 4-amino-3-methyl-N,N-diethylaniline salts and 4-amino-3-methyl-N-ethyl-N-methoxyethylaniline salts, readily distributes itself in an oil droplet phase containing couplers, etc. to show enhanced developing performance and has therefore been regarded advantageous for short time development (see U.S. Pat. Nos. 3,656,950, 3,656,925, and 4,035,188). On the other hand, where a color developing agent having a hydrophilic group as an N-substituent, such as 4-amino-3-methyl-N-ethyl-N-β-methanesulfonamidoethylaniline salts and 4-amino-3-methyl-N-ethyl-N-β-hydroxyethylaniline salts, is employed, benzyl alcohol has been used in combination to accelerate the distribution of the color developing agent into the oil droplet phase to thereby accelerate color development. In other words, in order to obtain sufficient image density, a large amount of a color developing agent should be maintained in the light-sensitive material until it is introduced into a bleach-fix bath. However, if color development is carried out with a color developing solution having the above-described hydrophobic group in a short time of within 20 seconds, development is retarded to a degree when increases towards the lowermost layer of the light-sensitive material. Thus an image having an extremely poor color balance is obtained. Addition of a large amount of benzyl alcohol to a developing solution increases the color density of the uppermost emulsion layer, while the color density of the lowermost emulsion layer remains unchanged, rather resulting in destroyed color balance. It also turned out that, when a light-sensitive material is bleach-fixed for a short time of 30 seconds or less while a color developing agent is present therein in a usual amount, uneven processing due to partial desilvering insufficiency occurs. It was ascertained that such processing unevenness becomes even greater in the presence of a large amount of benzyl alcohol. It was further found that the resulting image shows an abnormal increase in stain density when preserved under light irradiation at high humidity.

In order to solve these problems, extensive investigations were conducted and, as a result, it has been found that an image free from unevenness due to desilvering insufficiency and light stain can be obtained even with a bleach-fix of 30 seconds or less by using, contrary to conventional knowledge, a hydrophilic color developing agent and by reducing the amount of a color developing agent taken up into the light-sensitive material to be bleach-fixed to 1 mmol/$m^2$ or less (preferably 0.6 mmol/$m^2$ or less). Reduction of the amount of color developing agent in the light-sensitive material can be achieved, for example, by decreasing the thickness of the swollen light-sensitive material (this can be done by, for example, controlling the amount of a hydrophilic binder, e.g., gelatin, and the amount of hardening agent), by washing the color development processed light-sensitive material with water or immersing the color development processed light-sensitive material in water which is neutral to acidic or in a neutral or acidic buffer solution (preferably having a pH ranging from 3 to 7) to remove the color developing agent, or by reducing the amount of high-boiling organic solvent used as a dispersing medium for organic materials (preferably 2 g/$m^2$ or less, more preferably 0.6 to 1.8 g/$m^2$). While it is acceptable for the developed light-sensitive material to be treated with water, etc. to remove the color developing agent therefrom and then subjecting the material to a bleach-fix, such a method is not favorable because of the increase in number of baths and the increase in processing time. Further, it is preferred that the amount of a color developing agent in the light-sensitive material is 0.3 mmol/$m^2$ or more. If the amount is less than 0.3 mmol/$m^2$, a sufficient image density cannot be obtained in a short-time development as in the present invention.

For the purpose of achieving ultra-rapid development within 20 seconds, it was found preferred to rapidly supply a color developing agent to the lowermost layer, i.e., to use a color developing agent which is hardly trapped by an oil droplet phase and exhibits high diffusibility, and also to use substantially no benzyl alcohol which accelerates distribution of a color developing agent into the oil droplet phase. Considering that a large amount of benzyl alcohol has been believed useful to speed up color development and has been actually employed for that purpose, the above-described behavior in ultra-rapid color development is utterly unexpected. These means for rapid development are also effective in the above-described rapid bleach-fix as well, and speeding up of each processing step can be accomplished only by the present invention. Thus, the present invention makes it feasible to accomplish ultra-rapid processing throughout all processing steps.

In the present invention, since the amount of a color developing agent present in the film of a light-sensitive material is reduced, the rate of replenishment in subsequent steps, i.e., bleach-fix and washing, during continuous processing can now be greatly reduced.

As stated above, the present invention simultaneously achieves a reduction in rate of replenishment in each processing step along with ultra-rapid processing.

A color light-sensitive material contains a hydrophilic binder, such as high polymeric compounds, e.g., gelatin and polyacrylamide. The swell characteristics of the film in a processing solution can be changed by appropriately selecting the kind and amount of the binder or hardening agent therefor used in the light-sensitive material. The thickness of the swollen film is preferably 18 μm or less, and more preferably 6 to 15 μm. In order for a processing solution to penetrate rapidly into a light-sensitive material, the light-sensitive material preferably has a swell time (time required for the film swell to 80% of the maximum swollen film thickness as measured in a color developing solution with a conventional swelling meter) of 15 seconds or less and has a maximum swollen film thickness of 20 μm or less. By control of the swell characteristics, residual amounts of various components in the light-sensitive material can be reduced, and these residual components can be rapidly dissolved out of the film. Additionally, the drying load can be greatly diminished.

Effective color developing agents which can be used in the present invention preferably have a hydrophilicity-imparting group and a logP value of not more than 1.0. The symbol "P" is the calculated partition coefficient of a chemical substance, which is the proportion of distribution of the dissolved chemical substance between two phases comprising water (aqueous phase) and a substantially water-incompatible liquid (oily phase). The logP value used in the present invention was calculated by the method described in JP-A-64-56625, JP-A-64-61431, and a preprint for lectures of The 9th Information Chemistry Conference (Oct., 27, 1986), pp. 20–23.

Illustrative but non-limiting examples of the effective color developing agents are compounds represented by formula (I) shown below, and preferably the compounds of formula (I) have a logP value of 1.0 or less.

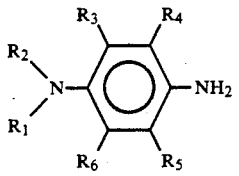

(I)

wherein $R_1$ and $R_2$ each represents a substituted or unsubstituted alkyl group; and $R_3$, $R_4$, $R_5$, and $R_6$ each represents a hydrogen atom, a substituted or unsubstituted alkyl group, a substituted or unsubstituted alkoxy group, a sulfo group, or a carboxyl group; or $R_1$ and $R_2$ can combine to form a 5- to 7-membered nitrogen-containing heterocyclic ring; at least one of $R_1$, $R_2$, $R_3$, $R_4$, $R_5$, and $R_6$ represents a substituted alkyl or alkoxy group having a water solubility-imparting group.

In formula (I), examples of water-solubility-imparting groups typically include a hydroxyalkyl group having from 2 to 4 carbon atoms, a methanesulfonamidoalkyl group having from 2 to 4 carbon atoms in the alkyl moiety thereof, $-C_2H_4CO_2H$, and $-C_2H_4SO_3H$. Since the stored as a free amine, generally a salt of an inorganic or organic acid is produced and stored so that a free amine is formed when adding at the processing. Examples of inorganic or organic acids for salt-forming the compounds of formula (I) include hydrochloric acid, sulfuric acid, nitric acid, phosphoric acid, p-toluenesulfonic acid, methansulfonic acid, and naphthalene-1,5-diphosphonic acid.

Specific but non-limiting examples of the compounds represented by formula (I) are shown below. The values in the parentheses denote logP values.

1) 4-Amino-3-methyl-N-ethyl-N-β-hydroxyethylaniline salt (0.807)
2) 4-Amino-3-methyl-N-ethyl-N-(3-hydroxypropyl)aniline salt (0.848)
3) 4-Amino-N-ethyl-N-β-hydroxyethylaniline salt (0.492)
4) 4-Amino-3-methyl-N-ethyl-N-β-methanesulfonamidoethylaniline salt (0.869)
5) 4-Amino-3-β-hydroxyethyl-N,N-diethylaniline salt (0.942)
6) 4-Amino-3-β-methanesulfonamidoethyl-N,N-diethylaniline salt (0.673)
7) 4-Amino-N,N-di-β-hydroxyethylaniline salt (−0.435)
8) 4-Amino-3-methyl-N-ethyl-N-carboxyethylaniline salt (−1.432)
9) 4-Amino-3-methoxy-N-ethyl-N-β-hydroxyethylaniline salt (0.381)
10) 4-Amino-3-methyl-N-ethyl-N-β-methanesulfonamidobutylaniline salt (0.758)

These compounds may be used either individually or as a combination of two or more thereof.

The color developing agent is preferably used in an amount of from 1.0 to 60 g/l, and more preferably from 2.0 to 30 g/l. For completing development in a short time, the developing temperature is preferably 30° C. or higher.

It is also more preferable to use a developing solution containing substantially no sulfite ion. In addition to serving as a preservative for a developing agent, sulfite ion has the effect of dissolving silver halide and the effect of reducing dye formation efficiency on reacting with an oxidation product of a developing agent. These effects of a sulfite ion appear to be one of the causes of an increase in variation of the photographic characteristics accompanying continuous processing. The terminology "substantially no sulfite ion" as used herein means that the amount of sulfite ion is preferably not more than $3.0\times10^{-3}$ mol/l, and more preferably zero. Note that the sulfite ion as above referred to excludes the use of a trace amount of sulfite ion as an antioxidant in a processing kit containing a concentrated developing agent before preparation of the developing solution.

In addition to no substantial sulfite ion being present, the developing solution preferably contains substantially no hydroxylamine as well. This is because hydroxylamine not only functions as a preservative for a developing solution but has intrinsic silver development activity. Therefore, variation in the hydroxylamine amount appears to greatly influence the photographic characteristics. The terminology "substantially no hydroxylamine" as used herein means that the amount of hydroxylamine is preferably not more than $5.0\times10^{-3}$ mol/l, and more preferably is zero.

Accordingly, the developing solution preferably contains an organic preservative instead of the above-mentioned hydroxylamine or sulfite ion. Organic preservatives which can be used are organic compounds capable of reducing the rate of deterioration of the aromatic primary amine color developing agent, i.e., organic compounds having the function of preventing oxidation, e.g., air oxidation of a color developing agent. Particularly effective organic preservatives are hydroxylamine derivatives (exclusive of hydroxylamine, hereinafter the same), hydroxamic acids, hydrazines, hydrazides, phenols, α-hydroxyketones, α-aminoketones, saccharides, monoamines, diamines, polyamines, quaternary ammonium salts, nitroxyl radicals, alcohols, oximes, diamide compounds, and condensed cyclic amines. Examples of these organic preservatives are described, e.g., in JP-A-63-4235, JP-A-63-30845, JP-A-63-21647, JP-A-63-44655, JP-A-63-53551, JP-A-63-

43140, JP-A-63-56654, JP-A-63-58346, JP-A-63-43138, JP-A-63-146041, JP-A-63-44657, JP-A-63-44656, U.S. Pat. Nos. 3,615,503 and 2,494,903, JP-A-52-143020, and JP-B-30496 (the term "JP-B" as used herein means an "examined Japanese patent publication").

If desired, the developing solution may further contain, as a preservative, various metals described in JP-A-57-44148 and JP-A-57-53749, salicylic acid derivatives described in JP-A-59-180588, alkanolamines described in JP-A-54-3532, polyethyleneimines described in JP-A-56-94349, aromatic polyhydroxyl compounds described in U.S. Pat. No. 3,746,544, etc. In particular, alkanolamines, e.g., triethanolamine, dialkylhydroxylamines, e.g., diethylhydroxylamine, hydrazine derivatives, or aromatic polyhydroxyl compounds are preferred as preservatives.

Particularly preferred organic preservatives are hydroxylamine derivatives and hydrazine derivatives (i.e., hydrazines and hydrazides). Specific examples of these organic preservatives and their use are described in JP-A-1-97953, JP-A-1-186939, JP-A-1-186940, and JP-A-1-187557.

To improve the stability of the color developing solution which leads to improved stability of continuous processing, it is more preferable to use a combination of the above-described hydroxylamine derivative or hydrazine derivative with an amine. Examples of suitable amines to be used in combination therewith include cyclic amines as described in JP-A-63-239447, the amines described in JP-A-63-128340, and the amines described in JP-A-1-186939 and JP-A-1-187557.

The color developing solution to be used in the present invention preferably contains $3.5\times10^{-3}$ to $3.0\times10^{-1}$ mol/l, and particularly from $1\times10^{-2}$ to $2\times10^{-1}$ mol/l, of chloride ion. If the chloride ion concentration is more than $3\times10^{-1}$ mol/l, development tends to be retarded, which is unfavorable for accomplishing the object of the present invention of achieving rapid processing and obtaining a high maximum density. A chloride ion concentration less than $3.5\times10^{-3}$ mol/l is unfavorable for fog prevention.

Also, the color developing solution to be used in the present invention preferably contains from $5\times10^{-6}$ to $1.0\times10^{-3}$ mol/l, and particularly from $3.0\times10^{-5}$ to $5\times10^{-4}$ mol/l, of bromide ion. A bromide ion concentration exceeding $1\times10^{-3}$ mol/l retards development, and maximum density and sensitivity are reduced. With a bromide ion concentration of less than $1.0\times10^{-5}$ mol/l, fog cannot be sufficiently prevented.

Chloride and bromide ions may be directly added to a developing solution or may be supplied by dissolution from a light-sensitive material during development processing. In the former case, suitable chloride ion sources include sodium chloride, potassium chloride, ammonium chloride, lithium chloride, nickel chloride, magnesium chloride, manganese chloride, calcium chloride, and cadmium chloride, with sodium chloride and potassium chloride being preferred. The chloride ion may also be supplied by a fluorescent brightening agent incorporated into a developing solution.

Suitable bromide ion sources include sodium bromide, potassium bromide, ammonium bromide, lithium bromide, calcium bromide, magnesium bromide, manganese bromide, nickel bromide, cadmium bromide, cerium bromide, thallium bromide, with potassium bromide and sodium bromide being preferred.

Where a chloride and a bromide ion are dissolved out from a light-sensitive material, they may be supplied either from the emulsions or other materials.

The color developing solution which can be used in the present invention preferably has a pH between 9 and 12, and more preferably between 9 and 11.0.

The color developing solution also may contain various known additives.

For example, various buffering agents are preferably used to maintain the above-recited pH range. Examples of suitable buffering agents include carbonates, phosphates, borates, tetraborates, hydroxybenzoic acid salts, glycine salts, N,N-dimethylglycine salts, leucine salts, norleucine salts, guanine salts, 3,4-dihydroxyphenylalanine salts, alanine salts, aminobutyric acid salts, 2-amino-2-methyl-1,3-propanediol salts, valine salts, proline salts, trishydroxyaminomethane salts, and lysine salts. In particular, carbonates, phosphates, tetraborates, and hydroxybenzoates are preferred because they have excellent solubility and buffering ability in a high pH range of 9.0 or more, do not adversely influence the photographic performance (e.g., fog) when added to a color developing solution, and are inexpensive.

Specific but non-limiting examples of suitable buffering agents are sodium carbonate, potassium carbonate, sodium bicarbonate, potassium bicarbonate, sodium tertiary phosphate, potassium tertiary phosphate, sodium secondary phosphate, potassium secondary phosphate, sodium borate, potassium borate, sodium tetraborate (borax), potassium tetraborate, sodium o-hydroxybenzoate (sodium salicylate), potassium o-hydroxybenzoate, sodium 5-sulfo-2-hydroxybenzoate (sodium 5-sulfosalicylate), and potassium 5-sulfo-2-hydroxybenzoate (potassium 5-sulfosalicylate).

The buffering agent is preferably present in the color developing solution in an amount of 0.1 mol/l or more, and more preferably from 0.1 to 0.4 mol/l.

Various chelating agents can be used in the color developing solution to prevent precipitation of calcium or magnesium or to improve the stability of the developing solution. Examples of suitable chelating agents include nitrilotriacetic acid, diethylenetriaminepentaacetic acid, ethylenediaminetetraacetic acid, N,N,N-trimethylenephosphonic acid, ethylenediamine-N,N,N',N'-tetramethylenesulfonic acid, trans-cyclohexanediaminetetraacetic acid, 1,2-diaminopropanetetraacetic acid, glycol ether diaminetetraacetic acid, ethylenediamine o-hydroxyphenylacetic acid, 2-phosphonobutane-1,2,4-tricarboxylic acid, 1-hydroxyethylidene-1,1-diphosphonic acid, and N'N'-bis(2-hydroxybenzyl)ethylenediamine-N'N'-diacetic acid. These chelating agents may be used either individually or as a combination of two or more thereof.

The chelating agent is present in an amount sufficient to sequester metallic ions in the color developing solution, usually in an amount of from about 0.1 g to about 10 g per liter.

If desired, a developing accelerator may be added to a color developing solution. Examples of suitable developing accelerators include thioether compounds as described in JP-B-37-16088, JP-B-37-5987, JP-B-38-7826, JP-B-44-12380, JP-B-45-9019, and U.S. Pat. No. 3,813,247; p-phenylenediamine compounds as described in JP-A-52-49829 and JP-A-50-15554; quaternary ammonium salts as described in JP-A-50-137726, JP-B-44-30074, JP-A-56-156826, and JP-A-52-43429; amine compounds as described in U.S. Pat. Nos. 2,494,903, 3,128,182, 4,230,796, and 3,253,919, JP-B-41-11431, and U.S. Pat. Nos. 2,482,546, 2,596,926, and 3,582,346; polyalkylene oxides as described in JP-B-37-16088, JP-B-42-25201, U.S. Pat. No. 3,128,183, JP-B-41-11431, JP-B-42-23883, and U.S. Pat. No. 3,532,501; 1-phenyl-3-pyrazolidones; and imidazoles.

If desired, an antifoggant may also be added to the color developing solution. Examples of suitable antifoggants include alkali metal halides, e.g., sodium chloride, potassium bromide and potassium iodide; and organic antifoggants. Typical examples of suitable organic antifoggants are nitrogen-containing heterocyclic compounds, e.g., benzotriazole, 6-nitrobenzimidazole, 5-nitroisoindazole, 5-methylbenzotriazole, 5-nitrobenzotriazole, 5-chlorobenzotriazole, 2-thiazolylbenzimidazole, 2-thiazolylmethylbenzimidazole, indazole, hydroxyazaindolizine, and adenine.

The color developing solution preferably contains a fluorescent brightening agent. Examples of suitable fluorescent brightening agents include 4,4'-diamino-2,2'-disulfostilbene compounds. The fluorescent brightening agent is used in an amount of up to 5 g/l, and preferably from 0.1 to 4 g/l.

If desired, various surface active agents, such as alkylsulfonic acids, arylsulfonic acids, aliphatic carboxylic acids, and aromatic carboxylic acids, may also be present in the color developing solution.

Where the rate of replenishment is reduced, it is preferable to prevent evaporation and air oxidation of the color developing solution by decreasing the open area of the processing tank in contact with air. The open area of the processing tank can be expressed in terms of the opening ratio calculated by dividing the contact area ($cm^2$) of the processing solution with air by the volume ($cm^3$) of the processing solution. The opening ratio as defined above is preferably not more than 0.1, and more preferably between 0.001 and 0.05.

The opening ratio of the processing tank can be so adjusted by, for example, putting a barrier, such as a floating cover, on the liquid surface, using a movable cover as described in JP-A-62-241342, or utilizing slit development processing as described in JP-A-63-216050.

Reduction in the opening ratio is preferably used not only for color development/black-and-white development but also for other subsequent steps, such as bleach, bleach-fix, fixing, washing, and stabilization.

Desilvering is generally carried using procedures, such as bleach followed by fixing, fixing followed by bleach-fix, bleach followed by bleach-fix, and bleach-fix.

Bleaching agents which can be used in the bleaching or bleach-fix solution are not particularly limited. Preferred bleaching agents include organic complex salts of iron (III) (e.g., complex salts with aminopolycarboxylic acids, e.g., ethylenediaminetetraacetic acid and diethylenetriaminepentaacetic acid, aminopolyphosphonic acids, phosphonocarboxylic acids, and organic phosphonic acids); organic acids, e.g., citric acid, tartaric acid, and malic acid; persulfates; and hydrogen peroxide.

Of these bleaching agents, organic complex salts of iron (III) are particularly preferred from the standpoint of rapid processing and prevention of environmental pollution. Examples of the aminopolycarboxylic acids, aminopolyphosphonic acids, and organic phosphonic acids useful for forming iron (III) complex salts include ethylenediaminetetraacetic acid, diethylenetriaminepentaacetic acid, 1,3-diaminopropanetetraacetic acid, propylenediaminetetraacetic acid, nitrilotriacetic acid, cyclohexanediaminetetraacetic acid, methyliminodiacetic acid, iminodiacetic acid, and glycol ether diaminetetraacetic acid. Sodium, potassium, lithium or ammonium salts of these compounds are useful as well. Of these compounds, iron (III) complex salts formed by ethylenediaminetetraacetic acid, diethylenetriaminepentaacetic acid, cyclohexanediaminetetraacetic acid, 1,3-diaminopropanetetraacetic acid, and methyliminodiacetic acid are preferred because of their high bleaching ability. These ferric ion complex salts may be used in the form of a complex salt or the complex may be formed in situ in solution by using a ferric salt (e.g., ferric sulfate, ferric chloride, ferric nitrate, ammonium ferric sulfate, and ferric phosphate) and a chelating agent (e.g., aminopolycarboxylic acids, aminopolyphosphonic acids, and phosphonocarboxylic acids). The chelating agent may be used in excess over that necessary to form the ferric ion complex salt. Particularly preferred iron complex salts are aminopolycarboxylic acid iron complexes, which are used in an amount of from 0.01 to 1.0 mol/l, and preferably from 0.05 to 0.50 mol/l.

The bleaching bath, bleach-fix bath and/or a prebath thereof may contain various bleaching accelerators. Bleaching accelerators which are preferably used for their excellent bleaching performance include compounds having a mercapto group or a disulfide linkage as described in U.S. Pat. No. 3,893,858, German Patent 1,290,812, JP-A-53-95630, and *Research Disclosure*, No. 17129 (Jul., 1978); thiourea compounds as described in JP-B-45-8506, JP-A-52-20832, JP-B-53-32735, and U.S. Pat. No. 3,706,561; and halides (e.g., iodides and bromides).

The bleaching bath or bleach-fix bath may also contain a re-halogenating agent, such as bromides (e.g., potassium bromide, sodium bromide, and ammonium bromide), chlorides (e.g., potassium chloride, sodium chloride, and ammonium chloride), and iodides (e.g., ammonium iodide).

If desired, the bleaching bath or bleach-fix bath may further contain one or more inorganic or organic acids or alkali metal or ammonium salts thereof having a pH buffer action, e.g., borax, sodium metaborate, acetic acid, sodium acetate, sodium carbonate, potassium carbonate, phosphorous acid, phosphoric acid, sodium phosphate, citric acid, sodium citrate, and tartaric acid; and a corrosion inhibitor, e.g., ammonium nitrate and guanidine.

A fixing agent used in the bleaching bath or bleach-fix bath can be conventional water-soluble silver halide solvent, such as thiosulfates, e.g., sodium thiosulfate and ammonium thiosulfate; thiocyanates, e.g., sodium thiocyanate and ammonium thiocyanate; thioether compounds, e.g., ethylenebisthioglycolic acid and 3,6-dithia-1,8-octanediol; and thioureas. These fixing agents may be used either individually or as a combination of two or more thereof. A special bleach-fix bath containing a fixing agent in combination with a large quantity of a halide, e.g., potassium iodide, as described in JP-A-55-155354 can also be employed. Fixing agents which are preferably used in the present invention are thiosulfates, and particularly ammonium thiosulfate.

The fixing agent is used preferably in an amount of from 0.3 to 2 mol/l, and more preferably from 0.5 to 1.0 mol/l. The fixing or bleach-fix bath preferably has a pH of from 3 to 10, and more preferably from 5 to 9.

The bleach-fix bath may further contain various fluorescent brightening agents, defoaming agents, surface active agents, and organic solvents, e.g., polyvinyl pyrrolidone and methanol.

The fixing or bleach-fix bath preferably contains a sulfite ion-releasing compound, such as sulfites (e.g., sodium sulfite, potassium sulfite, ammonium sulfite), bisulfites (e.g., ammonium bisulfite, sodium bisulfite, potassium bisulfite), and metabisulfites (e.g., potassium metabisulfite, sodium metabisulfite, ammonium metabisulfite), as a preservative. These compounds are preferably present in an amount of from about 0.02 to 0.05 mol/l, and more preferably from 0.04 to 0.40 mol/l, calculated as a sulfite ion.

While a sulfite is generally used as a preservative, other compounds, such as ascorbic acid, carbonyl-bisulfite addition products, and carbonyl compounds, may also be used as a preservative.

The processing time in the bleach-fix bath preferably ranges from 5 to 120 seconds, more preferably from 10 to 60 seconds. Bleach-fix processing is carried out at a processing temperature usually ranging from 25° to 60 ° C., and preferably from 30° to 50 ° C. The rate of replenishment suitably ranges from 20 to 250 ml/m$^2$, preferably from 30 to 100 ml/m$^2$, of photographic material processed.

If desired, the fixing or bleach-fix bath may further contain a buffering agent, a fluorescent brightening agent, a chelating agent, a defoaming agent, an antifungal agent, and so on.

The silver halide color light-sensitive materials after desilvering such as fixing or bleach-fixing are generally subjected to washing and/or stabilization.

The amount of washing water used in the washing step can vary widely depending on the characteristics of the light-sensitive materials (e.g., the kind of photographic materials such as couplers present), the end use of the light-sensitive materials, the temperature of the washing water, the number of washing tanks (the number of stages), the replenishing system (e.g., counter-flow system or direct-flow system), and other various conditions. For example, the relationship between the number of washing tanks and the quantity of water in a multi-stage counter-flow system can be obtained by the method described in *Journal of the Society of Motion Picture and Television Engineers.* Vol. 64, pp. 248–253 (May, 1955). In general, the number of stages in a multi-stage counter-flow system is preferably from 2 to 6, and more preferably from 2 to 4.

The required amount of water can be greatly reduced to, for example, 0.5 to 1 l/m$^2$ or even less, and the effects of the present invention are markedly manifested using a multi-stage counter-flow system. On the other hand, there is a tendency for bacteria to grow in the tank as the water retention time increases, and the suspended bacterial cells adhere to the light-sensitive materials. This problem can be effectively eliminated by reducing the amount of calcium and magnesium ions in the washing water as described in JP-A-62-288838. Bactericides, such as isothiazolone compounds or thiabendazole compounds as described in JP-A-57-8542; chlorine type bactericides, e.g., chlorinated sodium isocyanurate, as described in JP-A-61-120145; benzotriazoles as described in JP-A-61-267761; copper ion; and other bactericides described in Hiroshi Horiguchi, *Bokin bobai no kagaku,* Sankyo Shuppan (1986), Eisei Gijutsukai (ed.), *Biseibutsu no mekkin, sakkin, bobai gijutsu* Kogyo Gijutsukai (1982), and Nippon Bokin Bobai Gakkai (ed.), *Bokin bobaizai jiten* (1986) can also be used.

The washing water may also contain a surface active agent as a draining agent and a chelating agent, e.g., EDTA., as a hard water softener.

The washing step may be followed by or replaced with stabilization processing. The stabilizing bath used contains a compound having the function of stabilizing the image, such as an aldehyde compound (e.g., formaldehyde), a buffering agent for adjustment to a pH suitable for dye stabilization, and an ammonium compound. The stabilizing bath may further contain the above-described various bactericides or antifungal agents to prevent proliferation of bacteria or to provide the processed light-sensitive material with mold resistance. The stabilizing bath may furthermore contain a surface active agent, a fluorescent brightening agent, and a hardening agent. Where stabilization is conducted in place of washing, any of conventional stabilizing techniques described, e.g., in JP-A-57-8543, JP-A-58-14834, and JP-A-60-220345 can be utilized. In addition, use of a chelating agent, e.g., 1-hydroxyethylidene-1,1-diphosphonic acid and ethylenediaminetetramethylenephosphonic acid, a magnesium compound, or a bismuth compound is also preferred.

A so-called rinsing bath may also be used as a washing water or a stabilizing bath after desilvering.

Washing or stabilization is preferably effected at a pH between 4 and 10, and more preferably between 5 and 8. The temperature is appropriately determined depending on the use or characteristics of the light-sensitive material and usually ranges from 15° to 45° C., and preferably from 20° to 40° C. While the time can vary, the shorter the time, the better for reduction of the processing time. The time is preferably from 15 to 105 seconds, and more preferably from 30 to 90 seconds. The rate of replenishment is preferably as low as possible from the standpoint of reducing the running cost and waste liquid and handling. A preferred amount of replenisher is from 0.5 to 50 times, and particularly from 0.5 to 3 times, the amount of carry-over from the prebath per unit area of the light-sensitive material, or not more than 500 ml/m$^2$, and preferably not more than 120 ml/m$^2$. Replenishment may be conducted either continuously or intermittently.

The solution used in the washing and/or stabilization step may be recycled to a preceding step, if desired. For example, the overflow from the washing step, whose amount is reduced by using the above-described multi-stage counter-flow system, may be recycled to the preceding bleach-fix bath while replenishing the bleach-fix bath with a concentrated processing solution to thereby reduce the amount of waste liquid generated.

After washing and/or stabilization, the light-sensitive material is dried in a conventional manner, for example, at a temperature of from room temperature to 90° C. for a period of from 10 seconds to 10 minutes. Drying can be omitted.

Each of the above-described processing solutions is used at a temperature range of from 10° to 50° C. While a standard processing temperature is between 33° C. and 38° C., a higher temperature may be employed for processing acceleration or time reduction, or a lower temperature may be employed for improving the image quality or stability of the processing solution.

Cobalt intensification or hydrogen peroxide intensification may be performed as described in West German Patent 2,226,770 or U.S. Pat. No. 3,674,499 to conserve silver.

The color photographic light-sensitive material which can be used in the present invention usually comprises a support having thereon at least one blue-sensitive silver halide emulsion layer, at least one green-sensitive silver halide emulsion layer, and at least one red-sensitive silver halide emulsion layer. In general, color papers comprise these light-sensitive layers on a support in the order listed above but a different order may be used if desired. An infrared-sensitive silver halide emulsion layer may be used as a replacement for at least one of these emulsion layers, if desired. The light-sensitive emulsion layers each contains a silver halide emulsion sensitive to the different wavelength regions and a color coupler forming a dye of a color complementary to the light to which it is sensitive, that is, a yellow dye to blue light, a magenta dye to green light, and a cyan dye to red light, are present to thereby achieve color reproduction by the subtractive color process. The light-sensitive material may also have a structure in which the light-sensitive layers and the developed hue of the couplers do not have the above-described relationship.

Silver halide emulsions which can be used in the present invention preferably are silver chlorobromide or silver chloride emulsions containing substantially no silver iodide. The terminology "substantially no silver iodide" as used herein means that the amount of silver iodide present is not more than 1 mol %, and preferably not more than 0.2 mol %. While the halogen composition of the silver halide emulsion may be either the same or different in the individual grains, use of an emulsion having the same halogen composition in the grains makes it easy to obtain grains with uniform properties. The halogen composition may be uniformly distributed throughout the individual grains (homogeneous grains), or the individual grains may have a non-uniformly distributed halogen composition to form a laminate structure comprising a core and a single-layered or multi-layered outer shell or may have a non-layered portion differing in halogen composition in the inside or on the surface thereof (when such an area is on the surface, it is fused on the edge, corner or plane of the grains). Either of the latter two types of grains is preferred to homogeneous grains in order to obtain high sensitivity and also from the standpoint of pressure resistance. The boundary between the two layers or areas in these heterogeneous grains differing in halogen composition may be either clear or diffuse while forming mixed crystals due to the difference in composition. Further, the structure may be so designed to have a continuously varying halogen composition.

The silver halide grains in the high silver chloride emulsion preferably have a localized silver bromide layer(s) or areas (hereinafter inclusively referred to as a localized phase(s)) in the inside and/or on the surface of the individual grains. The localized phase preferably has a silver bromide content of at least 10 mol %, and more preferably more than 20 mol %. These localized phases may be present in the inside of the grains or on the surface (e.g., edges, corners, or planes) of the grains. One preferred example is an epitaxially grown area on the corner(s) of grains.

On the other hand, for the purpose of minimizing reduction in sensitivity on application of pressure to a light-sensitive material, a high silver chloride emulsion having a silver chloride content of 90 mol % or higher with its halogen composition being distributed in a narrow range throughout the individual grains is also preferably used.

The silver chloride content of the silver halide emulsions can be further increased to reduce the rate of replenishing the developing solution. In this case, an emulsion comprising nearly pure silver chloride having a silver chloride content of from 98 to 100 mol % is preferably used.

The silver halide grains in the silver halide emulsions preferably have a mean grain size of from 0.1 to 2 μm (the mean grain size is the number average of the diameter of a circle equivalent to the projected area of a grain).

The emulsion is preferably a mono-dispersion in which the grain size distribution has a coefficient of variation (obtained by dividing the standard deviation by the mean grain size) is not more than 20%, and preferably not more than 15%. Two or more kinds of mono-dispersed emulsions may be blended and coated in the same layer or may be separately coated in different layers to obtain a broad tolerance.

The silver halide grains of the photographic emulsions may have a regular crystal form, such as a cubic form, a tetradecahedral form, and an octahedral form; an irregular crystal form, such as a spherical form and a plate form; or a composite crystal form thereof. The grains may be a mixture of various crystal forms. In the present invention, the grains preferably comprise at least 50%, preferably at least 70%, and more preferably at least 90%, of those having a regular crystal form.

In addition, emulsions containing tabular grains having an average aspect ratio (circle-equivalent diameter/thickness ratio) of 5 or more, preferably 8 or more, in a proportion of at least 50% of the total grains expressed in terms of a projected area can also be used to advantage.

The silver chlorobromide emulsions which can be used in the present invention can be prepared by known methods as described in P. Grafkides, *Chemie et Physique Photographique*, Paul Montel (1967), G. F. Duffin, *Photographic Emulsion Chemistry*, The Focal Press (1966), and V. L. Zelikman, et al., *Making and Coating Photographic Emulsion*, The Focal Press (1964). More specifically, the emulsions can be prepared using the acid process, the neutral process, the ammonia process, etc. The reaction between a soluble silver salt and a soluble halogen salt can be carried out by a single jet process, a double jet process, a combination thereof, and the like.

The so-called reverse mixing process in which silver halide grains are formed in the presence of excess silver ions may also be used. The so-called controlled doublet jet process in which the pAg value of a liquid phase in which the silver halide grains are formed is maintained constant, may also be employed. A silver halide emulsion comprising grains having a regular crystal form and a nearly uniform grain size can be prepared using this process.

Various polyvalent metal ion impurities may be introduced into the silver halide emulsions which can be used in the present invention during silver halide grain formation or the subsequent physical ripening. Examples of useful compounds therefor include salts of cadmium, zinc, lead, copper, and thallium; and salts or complex salts of the group VIII metals, e.g., iron, ruthenium, rhodium, palladium, osmium, iridium, and platinum. The group VIII metal compounds are particularly preferred. These compounds are preferably used in an amount of from $1\times10^{-9}$ to $1\times10^{-2}$ mol per mol of silver halide, though the amount can vary widely depending on the end use of the light-sensitive material.

The silver halide emulsions are usually subjected to chemical sensitization and spectral sensitization.

Chemical sensitization of the silver halide emulsions can be achieved by sulfur sensitization represented by the addition of instable sulfur compounds, reduction sensitization, noble metal sensitization represented by gold sensitization or other known techniques, either alone or as a combination thereof. Compounds which can be preferably used for chemical sensitization are described in JP-A-62-215272, pp. 18–22.

Spectral sensitization is conducted to sensitize the emulsion of each light-sensitive layer to a spectral sensitivity in a desired light wavelength region. Spectral sensitization is preferably carried out by adding a dye which absorbs light of the wavelength region corresponding to the desired spectral sensitivity, i.e., a spectral sensitizing dye. Examples of suitable spectral sensitizing dyes include those described, e.g., in F. M. Harmer, *Heterocyclic Compounds-Cyanine Dyes and Relates Compounds,* John Wiley & Sons, New York, London (1964). Specific examples of preferred sensitizing dyes are described in JP-A-62-215272, pp. 22–38.

Various antifoggants or stabilizers or precursors thereof can be introduced into the photographic emulsions to prevent fog during preparation, preservation or photographic processing of light-sensitive materials or to stabilize the photographic performance properties of the light-sensitive materials. Specific examples of suitable compounds are described in JP-A-62-215272, pp. 39–72.

The emulsions which can be used in the present invention may be either a surface latent image type forming a latent image predominantly on the grain surface or an internal latent image type forming a latent image predominantly on the inside of the grain.

The color light-sensitive materials which can be used in the present invention generally contain yellow, magenta, and cyan couplers which develop yellow, magenta and cyan colors, respectively, on coupling with the oxidation product of an aromatic amine color developing agent.

Cyan, magenta, and yellow couplers which are preferred for use in the present invention are represented by the formulae (C-I), (C-II), M-I), (M-II) and (Y) shown below, respective.

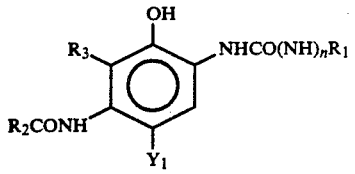

(C-I)

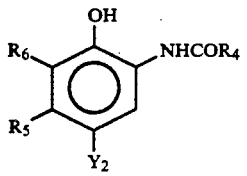

(C-II)

-continued

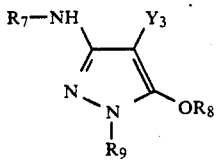

(M-I)

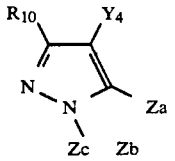

(M-II)

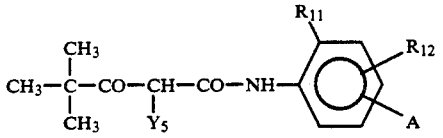

(Y)

In formulae (C-I) and (C-II), $R_1$, $R_2$, and $R_4$ each represents a substituted or unsubstituted aliphatic, aromatic or heterocyclic group; $R_3$, $R_5$, and $R_6$ each represents a hydrogen atom, a halogen atom, an aliphatic group, an aromatic group or an acylamino group; or $R_3$ represents a non-metal atomic group forming a 5- or 6-membered nitrogen-containing ring together with $R_2$; $Y_1$ and $Y_2$ each represents a hydrogen atom or a group releasable on coupling with an oxidation product of a developing agent; and n represents 0 or 1.

$R_5$ in formula (C-II) preferably represents an aliphatic group, e.g., methyl, ethyl, propyl, butyl, pentadecyl, t-butyl, cyclohexyl, cyclohexylmethyl, phenylthiomethyl, dodecyl, oxyphenylthiomethyl, butaneamidomethyl, and methoxymethyl groups.

Of the cyan couplers represented by formula (C-I) or (C-II), the following compounds are preferred.

In formula (C-I), $R_1$ preferably represents an aryl group or a heterocyclic group, and more preferably an aryl group substituted with a halogen atom, an alkyl group, an alkoxy group, an aryloxy group, an acylamino group, an acyl group, a carbamoyl group, a sulfonamido group, a sulfamoyl group, a sulfonyl group, a sulfamido group, an oxycarbonyl group, or a cyano group. When $R_3$ and $R_2$ do not form a ring, $R_2$ preferably represents a substituted or unsubstituted alkyl or aryl group, and more preferably an alkyl group substituted with a substituted aryloxy group, and $R_3$ preferably represents a hydrogen atom.

In formula (C-II), $R_4$ preferably represents a substituted or unsubstituted alkyl or aryl group, and more preferably an alkyl group substituted with a substituted aryloxy group. $R_5$ preferably represents an alkyl group having from 2 to 15 carbon atoms or a methyl group having a substituent containing at least one carbon atom. Substituents for the methyl group preferably include an arylthio group, an alkylthio group, an acylamino group, an aryloxy group, and an alkyloxy group. $R_5$ more preferably represents an alkyl group having from 2 to 15 carbon atoms, particularly from 2 to 4 carbon atoms. $R_6$ preferably represents a hydrogen atom or a halogen atom, and more preferably a chlorine atom or a fluorine atom.

In formulae (C-I) and (C-II), $Y_1$ and $Y_2$ each preferably represents a hydrogen atom, a halogen atom, an alkoxy group, an aryloxy group, an acyloxy group, or a sulfonamido group.

In formula (M-I), $R_7$ and $R_9$ each represents an aryl group; $R_8$ represents a hydrogen atom, an aliphatic or aromatic acyl group, or an aliphatic or aromatic sulfonyl group; and $Y_3$ represents a hydrogen atom or a releasable group.

In formula (M-I), the substituents for the aryl group (preferably a phenyl group) represented by $R_7$ or $R_9$ are the same as for $R_1$. When two or more substituents are present, they may be the same or different. $R_8$ preferably represents a hydrogen atom, an aliphatic acyl group, or an aliphatic sulfonyl group, and more preferably a hydrogen atom. $Y_3$ preferably represents a group releasable at any of a sulfur, oxygen and nitrogen atom. For example, sulfur-releasable groups as described in U.S. Pat. No. 4,351,897 and International Publication WO 88/04795 are particularly preferred.

In formula (M-II), $R_{10}$ represents a hydrogen atom or a substituent; $Y_4$ represents a hydrogen atom or a releasable group, and preferably a halogen atom or an arylthio group; $Z_a$, $Z_b$, and $Z_c$ each represents a methine group, a substituted methine group, =N—, or —NH—; either one of the $Z_a$—$Z_b$ bond and $Z_b$—$Z_c$ bond is a double bond, with the other being a single bond; when the $Z_b$—$Z_c$ bond is a carbon-carbon double bond, it may be a part of an aromatic ring; .and formula (M-II) may form a polymer inclusive of a dimer, at any of $R_{10}$, $Y_4$, or a substituted methine group represented by $Z_a$, $Z_b$ or $Z_c$.

Of the pyrazoloazole couplers of formula (M-II), imidazo[1,2-b]pyrazoles described in U.S. Pat. No. 4,500,630 are preferred from the standpoint of reduced yellow side absorption and fastness to light. Pyrazolo[1,5-b][1,2,4]triazoles described in U.S. Pat. No. 4,540,654 are particularly preferred.

Additional examples of suitable pyrazoloazole couplers include pyrazolotriazole couplers having a branched alkyl group at the 2-, 3- or 6-position of the pyrazolotriazole ring as described in JP-A-61-65245; pyrazoloazole couplers containing a sulfonamido group in the molecule thereof as described in JP-A-61-65246; pyrazoloazole couplers having an alkoxyphenylsulfonamido ballast group as described in JP-A-61-147254; and pyrazolotriazole couplers having an alkoxy group or an aryloxy group at the 6-position as described in European Patent Publication Nos. 226,849 and 294,785.

In formula (Y), $R_{11}$ represents a halogen atom, an alkoxy group, a trifluoromethyl group, or an aryl group; $R_{12}$ represents a hydrogen atom, a halogen atom, or an alkoxy group; A represents —$NHCOR_{13}$, —$NHSO_2$—$R_{13}$, —$SO_2NHR_{13}$, —$COOR_{13}$, or $$-SO_2\underset{\underset{R_{14}}{|}}{N}-R_{13}$$

(wherein $R_{13}$ and $R_{14}$ each represents an alkyl group, an aryl group, or an acyl group); and $Y_5$ represents a releasable group. The substituents for $R_{12}$, $R_{13}$, or $R_{14}$ are the same as for $R_1$. The releasable group $R_5$ is preferably a group releasable at an oxygen atom or a nitrogen atom, and more preferably a nitrogen-releasable group.

Specific examples of the couplers represented by formulae (C-I), (C-II), (M-I), (M-II), and (Y) are shown below.

(C-1)

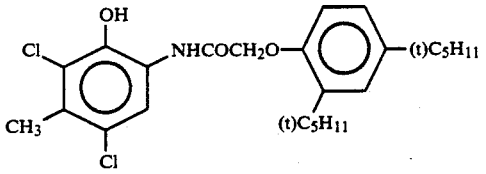

(C-2)

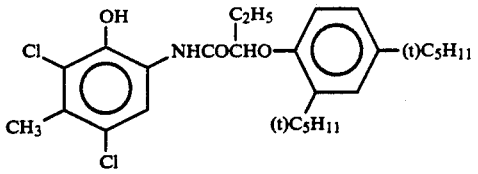

(C-3)

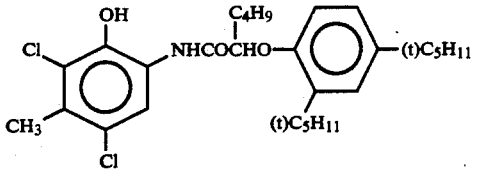

(C-4)

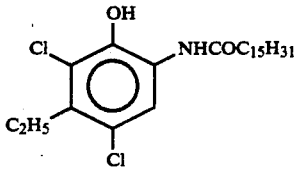

-continued
(C-5)
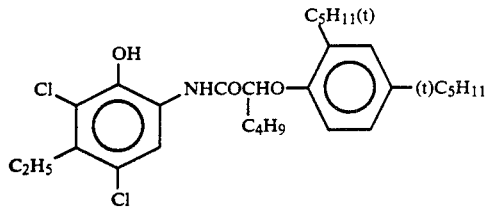
(C-6)
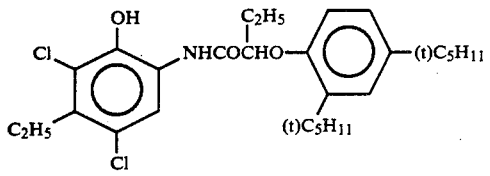
(C-7)
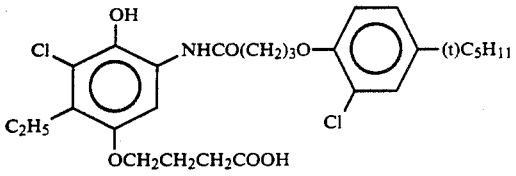
(C-8)
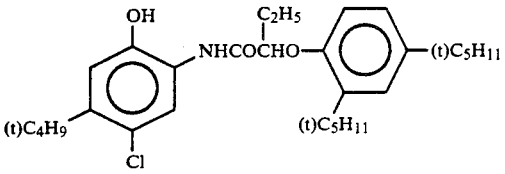
(C-9)
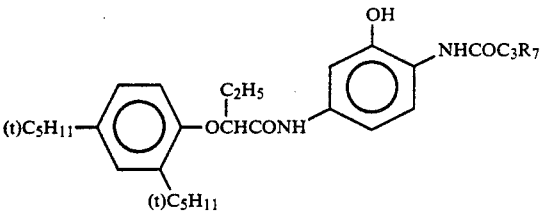
(C-10)
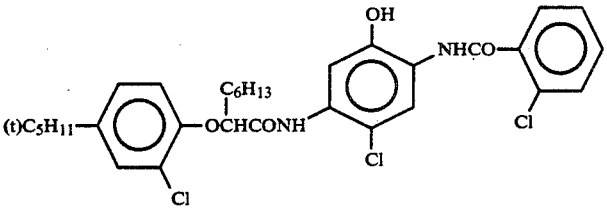
(C-11)
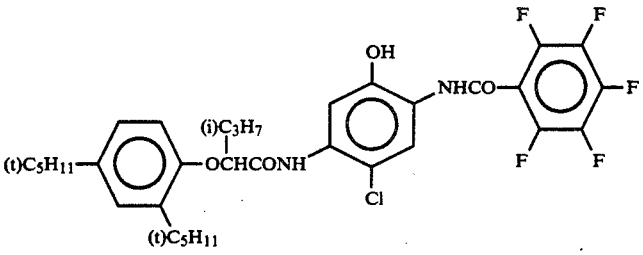

-continued
(C-12)
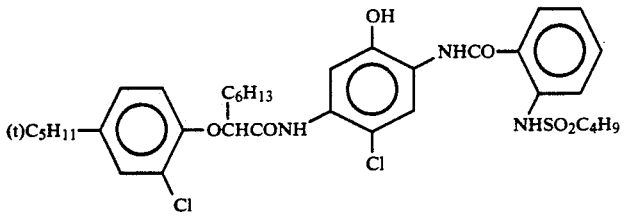
(C-13)
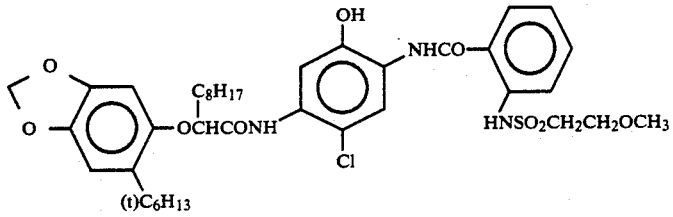
(C-14)
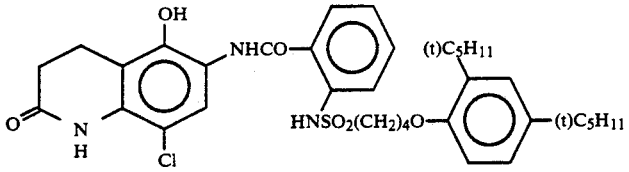
(C-15)
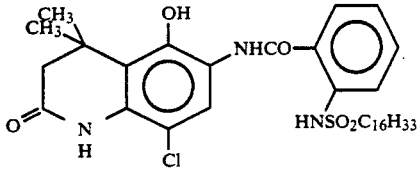
(C-16)
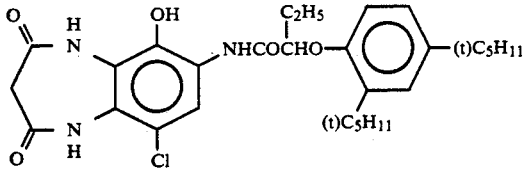
(C-17)
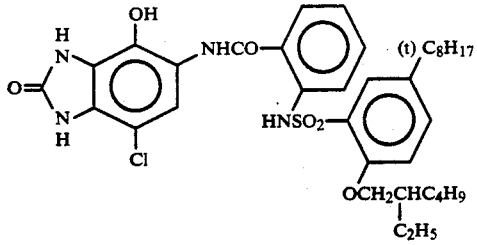
(C-18)
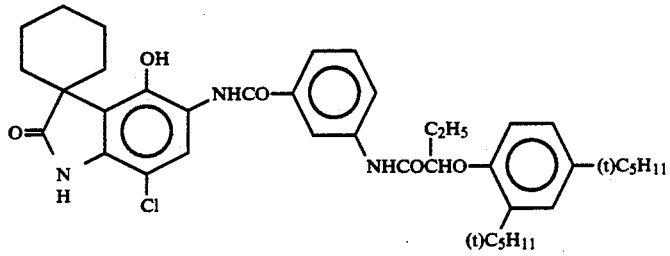

-continued
(C-19)
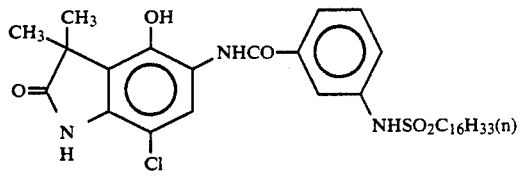
(C-20)
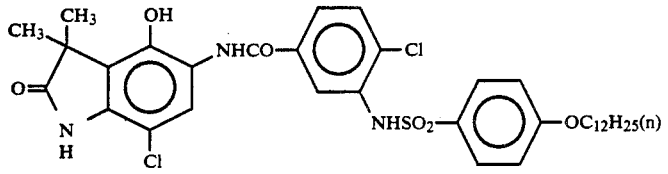
(C-21)
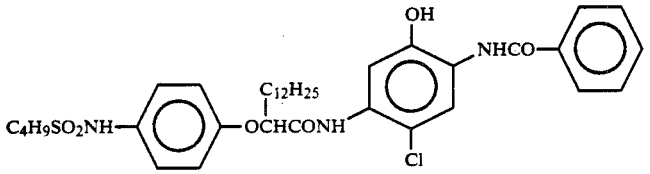
(C-22)
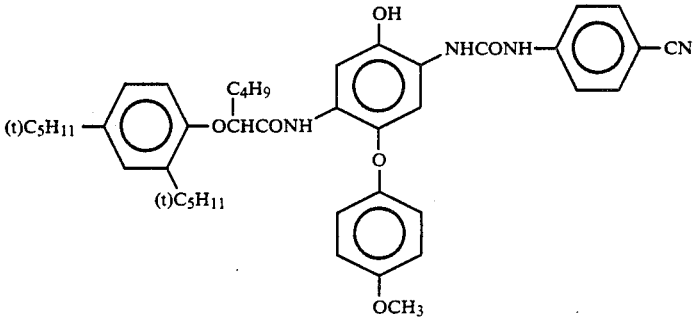
(M-1)
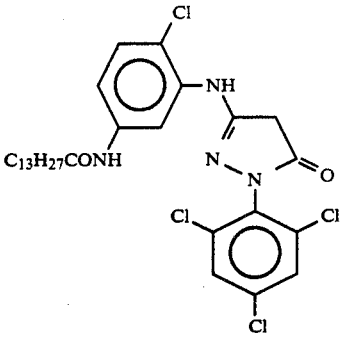
(M-2)
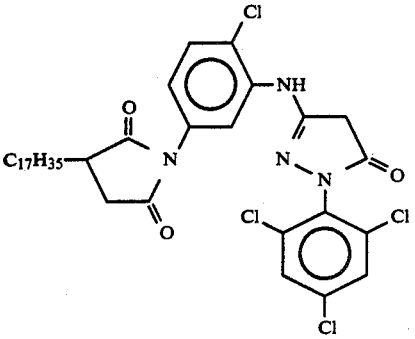

-continued
(M-3)
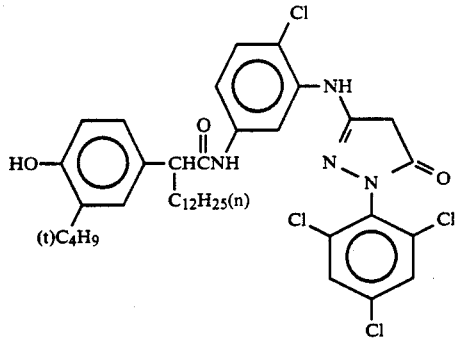
(M-4)
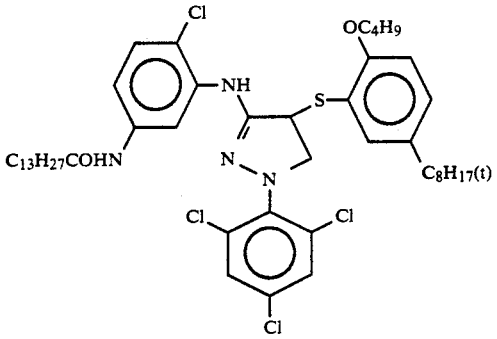
(M-5)
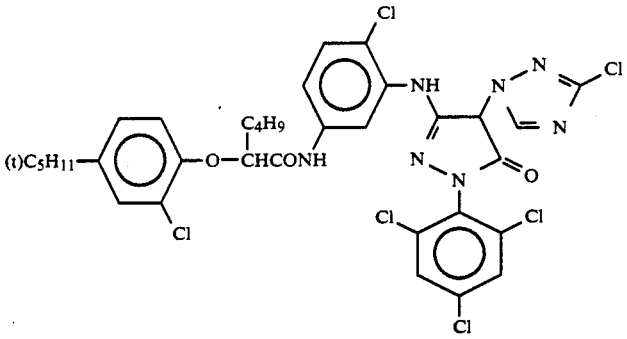
(M-6)
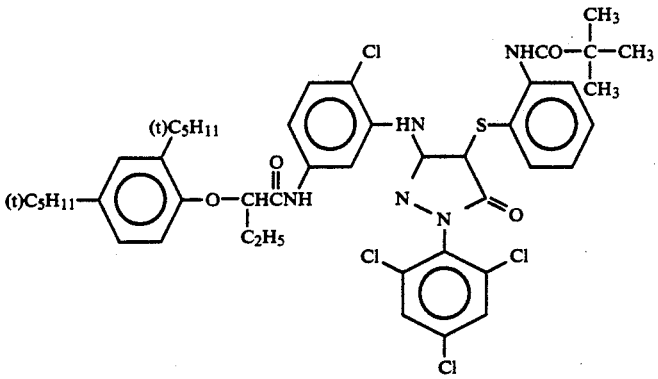

-continued
(M-7)
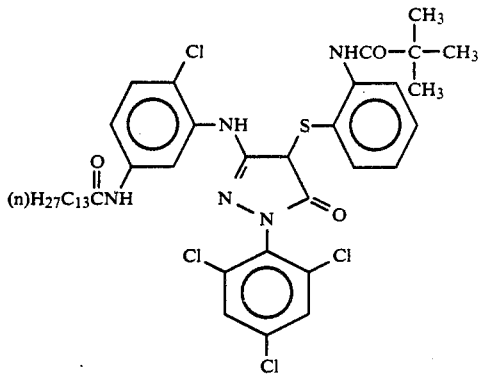
(M-8)
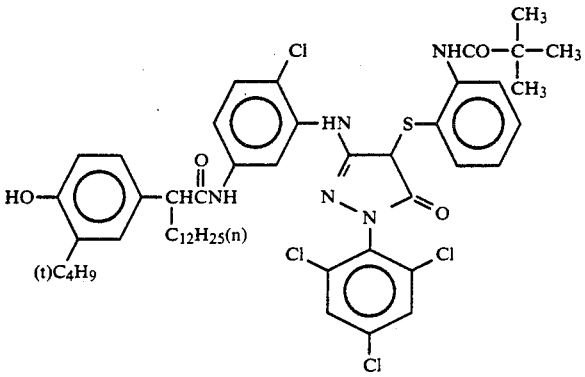
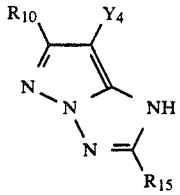
| compound | $R_{10}$ | $R_{15}$ | $Y_4$ |
|---|---|---|---|
| M-9 | $CH_3$— | 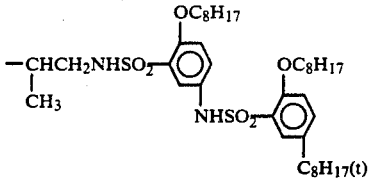 | Cl |
| M-10 | " | 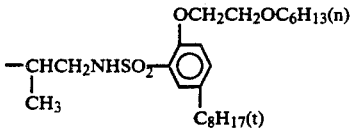 | " |
| M-11 | $(CH_3)_3C$— | 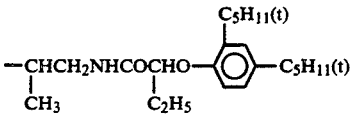 | 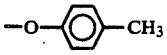 |
| M-12 | 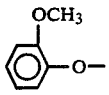 | 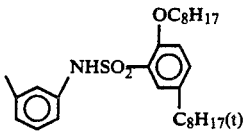 | 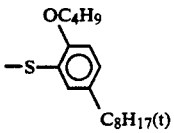 |

-continued
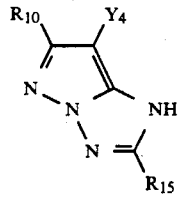
| compound | $R_{10}$ | $R_{15}$ | $Y_4$ |
|---|---|---|---|
| M-13 | $CH_3$— | 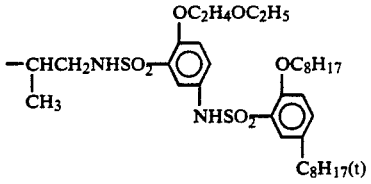 | Cl |
| M-14 | " | 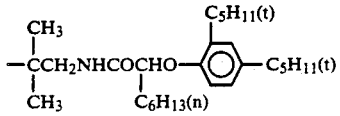 | " |
| M-15 | " | 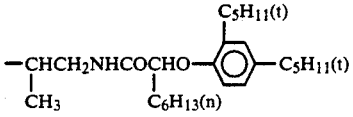 | " |
| M-16 | $CH_3$— | 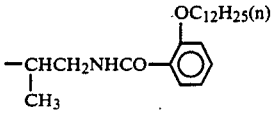 | Cl |
| M-17 | " | 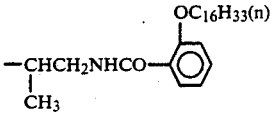 | " |
| M-18 | 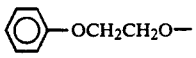 | 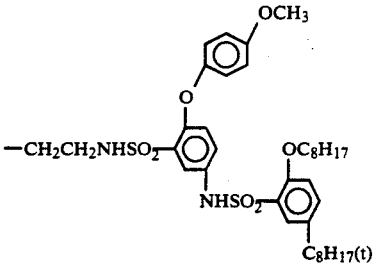 | 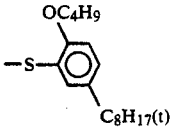 |
| M-19 | $CH_3CH_2O$— | " | " |
| M-20 | 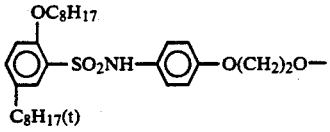 | 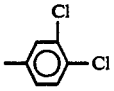 | 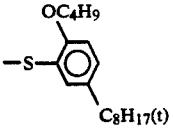 |
| M-21 | 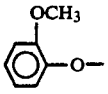 | 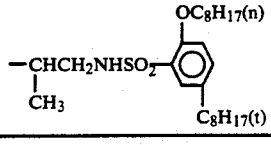 | Cl |

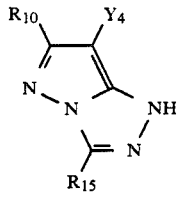
| compound | $R_{10}$ | $R_{15}$ | $Y_4$ |
|---|---|---|---|
| M-22 | $CH_3$— | 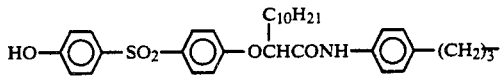 | Cl |
| M-23 | " | 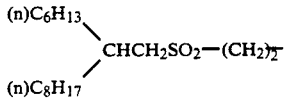 | " |
| M-24 | 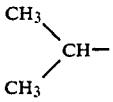 | 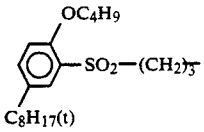 | " |
| M-25 | 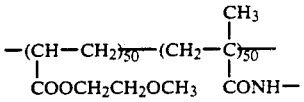 | 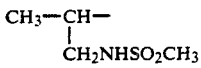 | " |
| M-26 | 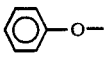 | 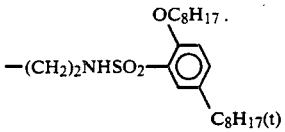 | Cl |
| M-27 | $CH_3$— | 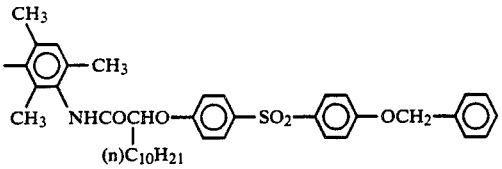 | " |
| M-28 | $(CH_3)_3C$— | 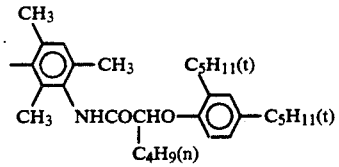 | " |
| M-29 | 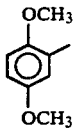 | 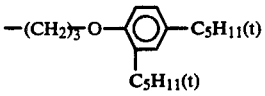 | Cl |
| M-30 | $CH_3$— | 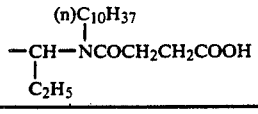 | " |

(Y-1)
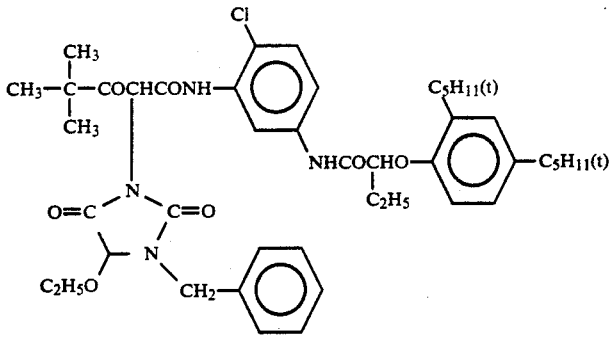
(Y-2)
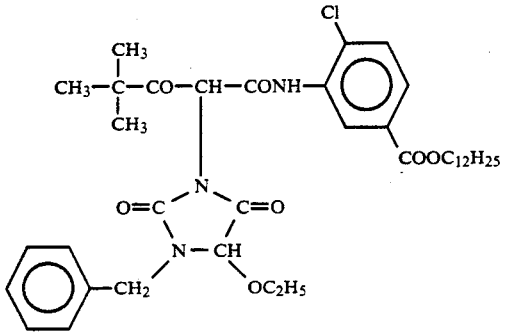
(Y-3)
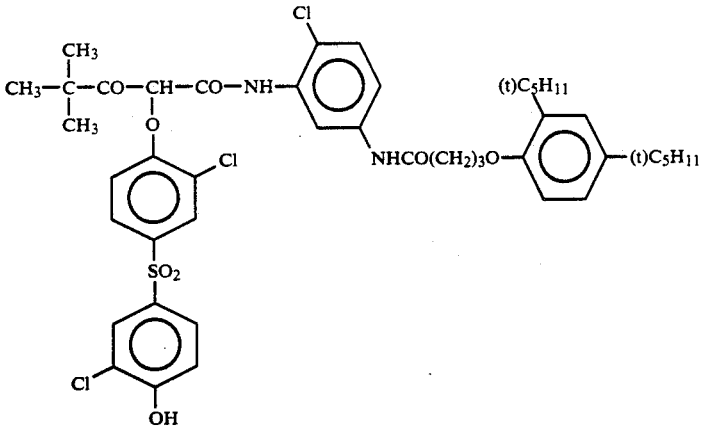
(Y-4)
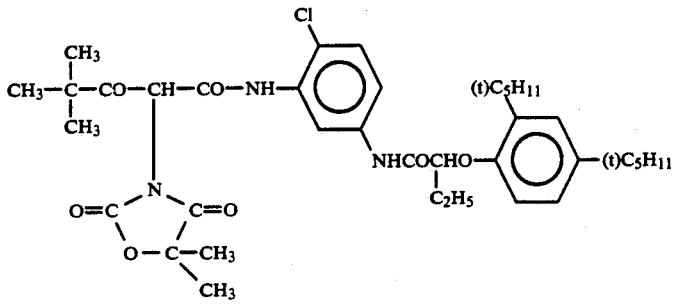

-continued
(Y-5)
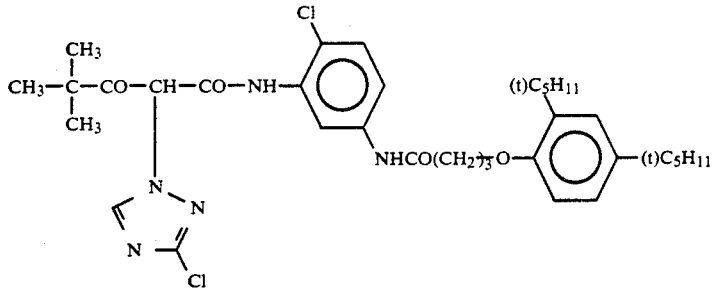
(Y-6)
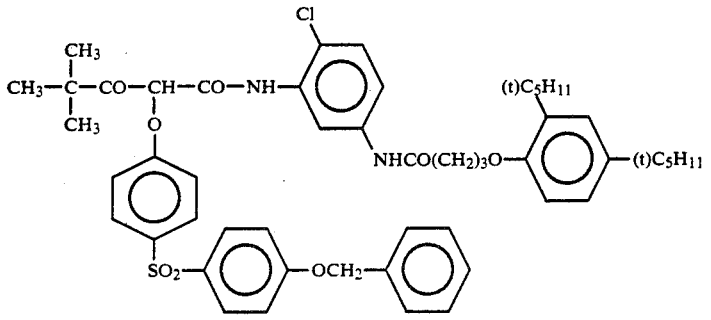
(Y-7)
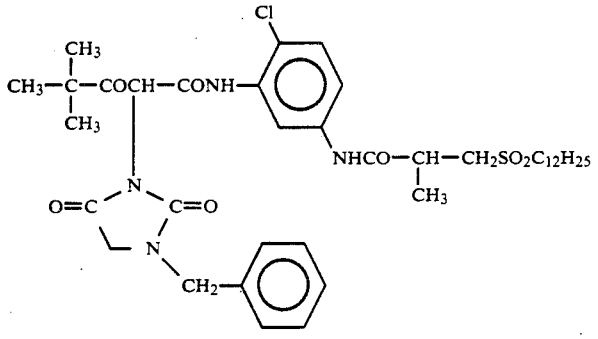
(Y-8)
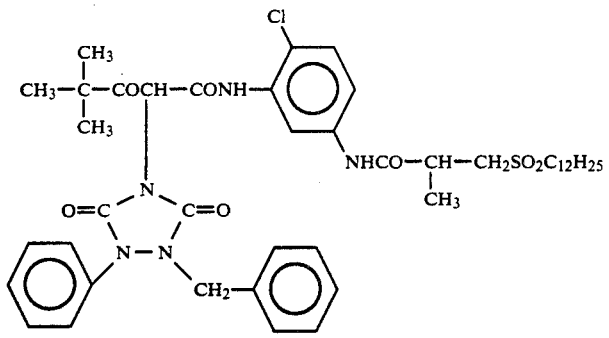
(Y-9)
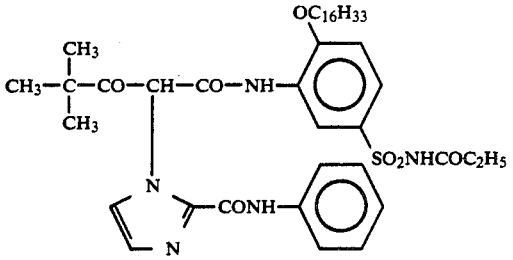
The coupler represented by formula (C-I), (C-II), (M-I), (M-II) or (Y) is present in a light-sensitive silver halide emulsion layer in an amount usually of from 0.1 to 1.0 mol, and preferably from 0.1 to 0.5 mol, per mol of silver halide.
The coupler can be incorporated into a light-sensitive layer using various known methods The coupler is generally added using an oil-in-water dispersion method known as an oil protection method, in which it is dissolved in a solvent and then emulsified and dispersed in a gelatin aqueous solution containing a surface active agent. Alternatively, water or a gelatin aqueous solution may be added to a coupler solution containing a surface active agent to obtain an oil-in-water dispersion through phase reversal. An alkali-soluble coupler may be dispersed by using the so-called Fischer's dispersion method. Any low-boiling organic solvent present in the coupler dispersion may be removed by distillation, noodle washing, ultrafiltration or a like technique before mixing the dispersion with a photographic emulsion.

The dispersing medium which can be used in the above-described dispersion methods preferably include high-boiling organic solvents and/or water-insoluble high polymeric compounds having a dielectric constant (at 25° C.) of from 2 to 20 and a refractive index (at 25° C.) of from 1.5 to 1.7.

Suitable high-boiling organic solvents preferably include those represented by formula (A) to (E).

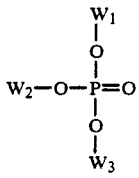
(A)

$W_1—COO—W_2$ (B)

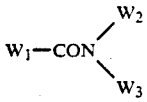
(C)

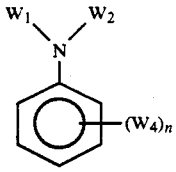
(D)

$W_1—O—W_2$ (E)

wherein $W_1$, $W_2$, and $W_3$ each represents a substituted or unsubstituted alkyl group, a substituted or unsubstituted cycloalkyl group, a substituted or unsubstituted alkenyl group, a substituted or unsubstituted aryl group, or a substituted or unsubstituted heterocyclic group; $W_4$ represents $W_1$, $OW_1$, or $S-W_1$; and n represents an integer of from 1 to 5; when n is 2 or greater, the plural $W_4$'s may be the same or different; $W_1$ and $W_2$ in formula (E) may form a condensed ring.

In addition to the compounds of formulae (A) to (E), water-immiscible high-boiling organic solvents having a melting point of not higher than 100° C. and a boiling point of not lower than 140° C. may also be used as long as they are good solvents for couplers. The high-boiling organic solvents to be used preferably have a melting point of 80° C. or lower and a boiling point of 160° C. or higher, and more preferably 170° C. or higher.

The details of these high-boiling organic solvents are disclosed in JP-A-62-215272, pp. 137–144.

It is also possible to impregnate the coupler into a loadable latex polymer (described, e.g., in U.S. Pat. No. 4,203,716) in the presence or absence of the above-described high-boiling organic solvent or dissolved in a water-insoluble and organic solvent-soluble polymer and emulsified and dispersed in a hydrophilic colloid aqueous solution. The homo- or copolymers described in International Publication WO 88/00723, pp. 12–30 are preferably employed. In particular, acrylamide polymers are preferred from the standpoint of dye image stability.

The light-sensitive material which can be used in the present invention may contain hydroquinone derivatives, aminophenol derivatives, gallic acid derivatives, ascorbic acid derivatives, etc. as a color fog inhibitor.

The light-sensitive material may also contain various discoloration inhibitors. Examples of suitable organic discoloration inhibitors for cyan, magenta and/or yellow images include hydroquinones, 6-hydroxychromans, 5-hydroxycoumarans, spirochromans, p-alkoxyphenols, hindered phenols chiefly including bisphenols, gallic acid derivatives, methylenedioxybenzenes, aminophenols, hindered amines, and ether or ester derivatives of these phenol compounds obtained by silylating or alkylating the phenolic hydroxyl group thereof. Metal complexes, such as (bissalicylaldoximato)nickel complexes and (bis-N,N-dialkyldithiocarbamato)nickel complexes, are also useful.

Specific examples of these organic discoloration inhibitors are the hydroquinones described in U.S. Pat. Nos. 2,360,290, 2,418,613, 2,700,453, 2,701,197, 2,728,659, 2,732,300, 2,735,765, 3,982,944, and 4,430,425, British Patent 1,363,921, and U.S. Pat. Nos. 2,710,801 and 2,816,028; the 6-hydroxychromans, 5-hydroxycoumarans, and spirochromans disclosed in U.S. Pat. Nos. 3,432,300, 3,573,050, 3,574,627, 3,698,909, and 3,764,337, and JP-A-52-152225; spiroindanes disclosed in U.S. Pat. No. 4,360,589; p-alkoxyphenols disclosed in U.S. Pat. No. 2,735,765, British Patent 2,066,975, JP-A-59-10539, and JP-B-57-19765; hindered phenols disclosed in U.S. Pat. No. 3,700,455, JP-A-52-72224, U.S. Pat. No. 4,228,235, and JP-B-52-6623; gallic acid derivatives, methylenedioxybenzenes, and aminophenols disclosed in U.S. Pat. Nos. 3,457,079 and 4,332,886, and JP-B-56-21144; hindered amines disclosed in U.S. Pat. Nos. 3,336,135 and 4,268,593, British Patents 1,326,889, 1,354,313, and 1,410,846, JP-B-51-1420, JP-A-58-114036, JP-A-59-53846, and JP-A-59-78344; and metal complexes disclosed in U.S. Pat. Nos. 4,050,938 and 4,241,155 and British Patent 2,027,731(A). These compounds are co-emulsified together with the coupler in an amount usually of from 5 to 100% by weight based on the coupler and added to a light-sensitive layer.

An ultraviolet absorbent can be incorporated into a cyan-forming layer and both layers adjacent thereto to more effectively present fading of a cyan dye image due to heat and particularly light.

Examples of suitable ultraviolet absorbents include benzotriazole compounds having an aryl substituent as described, e.g., in U.S. Pat. No. 3,533,794; 4-thiazolidone compounds as described, e.g., in U.S. Pat. Nos. 3,314,794 and 3,352,681; benzophenone compounds as described, e.g., in JP-A-46-2784; cinnamic ester compounds as described, e.g., in U.S. Pat. Nos. 3,705,805 and 3,707,395; butadiene compounds as described, e.g., in U.S. Pat. No. 4,045,229; and benzoxydol compounds as described, e.g., in U.S. Pat. Nos. 3,406,070, 3,677,672, and 4,271,307. Ultraviolet absorbing couplers (e.g., α-naphthol type cyan-forming couplers) or ultraviolet absorbing polymers are also useful. These ultraviolet absorbents may be mordanted in a specific layer. Of these ultraviolet absorbents, preferred are benzotriazole compounds having an aryl substituent.

The above-described couplers, particularly pyrazoloazole couplers are preferably used in combination with (F) a compound capable of chemically bonding to residual aromatic amine developing agent remaining after color development to form a chemically inactive and substantially colorless compound and/or (G) a compound capable of chemically bonding to a residual oxidation product of an aromatic amine developing agent remaining after color development to form a chemically inactive and substantially colorless compound. Such a combined use is advantageous to prevent staining and other side effects during preservation after processing which are due to a colored dye formation reaction between residual color developing agent or an oxidation product thereof and the coupler.

Compounds (F) preferably include compounds which react with p-anisidine with a rate constant of a second-odor reaction $k_2$ falling within a range of from 1.0 l/mol.sec to $1\times10^{-5}$ l/mol.sec (in trioctyl phosphate at 80° C.). The rate constant can be determined by the method described in JP-A-63-158545.

When $k_2$ is greater than the above range, the compound per se tends to be labile and to decompose on reacting with gelatin or water. Where $k_2$ is smaller than that range, the reaction with residual aromatic amine developing agent is too slow to prevent side effects due to the residual aromatic amine developing agent.

Preferred of compounds (F) are those represented by formulae (FI) and (FII):

$$R_1-(A)_n-X \quad \text{(FI)}$$

$$R_2-\underset{\underset{B}{|}}{C}=Y \quad \text{(FII)}$$

wherein $R_1$ and $R_2$ each represents an aliphatic group, an aromatic group, or a heterocyclic group; n represents 1 or 0; A represents a group capable of reacting with an aromatic amine developing agent to form a chemical bond; X represents a group which is released on reaction with an aromatic amine developing agent; B represents a hydrogen atom, an aliphatic group, an aromatic group, a heterocyclic group, an acyl group, or a sulfonyl group; and Y represents a group which accelerates addition of an aromatic amine developing agent to the compound (FII); and $R_1$ and X, or Y and $R_2$ or B may combine to form a cyclic structure.

The mode of chemically bonding to residual aromatic amine developing agent typically includes a substitution reaction and an addition reaction.

Specific examples of compounds of formulae (FI) and (FII) preferably include those described in JP-A-63-158545, JP-A-62-283338, and European Patent Publication Nos. 298321 and 277589.

Compounds (G) preferably include those represented by formulae (GI):

$$R\text{-}Z \quad \text{(GI)}$$

wherein R represents an aliphatic group, an aromatic group, or a heterocyclic group; and Z represents a nucleophilic group or a group capable of releasing a nucleophilic group on decomposition in a light-sensitive material.

In formula (GI), Z is preferably a group having a Pearson's nucleophilicity $^{n}CH_3I$ value (see R. G. Pearson, et al., *J. Am. Chem. Soc.*, Vol. 90, p. 319 (1968)) of 5 or more or a group derived therefrom.

Specific examples of compounds represented by formula (GI) preferably include those described in European Patent Publication No. 255722, JP-A-62-143048, JP-A-62-229145, JP-A-1-230039 and JP-A-1-57259, European Patent Publication Nos. 298321 and 277589.

Combinations of compounds (G) and compounds (F) are described in detail in European Patent Publication No. 277589.

The hydrophilic colloidal layers of the light-sensitive material may contain water-soluble dyes or dyes which become water-soluble by photographic processing as a filter dye or to prevent irradiation or halation or for other various purposes. These dyes include oxonol dyes, hemioxonol dyes, styryl dyes, merocyanine dyes, cyanine dyes, and azo dyes. In particular, oxonol dyes, hemioxonol dyes, and merocyanine dyes are useful.

Binders or protective colloids which can be used in the emulsion layers include gelatin advantageously. Other hydrophilic colloids may also be used either alone or in combination with gelatin.

The gelatin to be used in the present invention may be either lime-processed gelatin or acid-processed gelatin. The details of the preparation of gelatin are described in Arthur Vice, *The Macromolecular Chemistry of Gelatin*, Academic Press (1964).

Supports which can be generally used in the light-sensitive material include transparent films commonly employed in photographic light-sensitive materials, e.g., a cellulose nitrate film and a polyethylene terephthalate film, and a reflective support. A reflective support is preferred for accomplishing the object of the present invention.

The terminology "reflective support" as used herein means a support having increased reflecting properties resulting in the dye image formed in the silver halide emulsion layers being more distinct. Such a reflective support includes a support having coated thereon a hydrophobic resin having dispersed therein a light reflecting substance, e.g., titanium oxide, zinc oxide, calcium carbonate, and calcium sulfate; and a support made from a hydrophobic resin having dispersed therein the above-described light reflecting substance. Specific examples of suitable reflective supports include baryta paper, polyethylene-coated paper, polypropylene type synthetic paper; and transparent supports, e.g., a glass plate, a polyester film (e.g., polyethylene terephthalate, cellulose triacetate, cellulose nitrate), a polyamide film, a polycarbonate film, a polystyrene film, and a vinyl chloride resin film, having thereon a reflective layer or containing therein a reflective substance.

In addition, a support with a metallic surface exhibiting specular reflection or diffused reflection of the second kind can also be used as a reflective support. The term "diffused reflection of the second kind" as used herein is defined, for example, in *Shikisai-Kagaku Handbook*, 5th Ed., Chapter 18, Para. 1, edited by Nippon Shikisai Gakkai and published by Tokyo University Shuppan-Kai (1985). The metallic surface preferably has a spectral reflectance of 0.5 or more in the visible wavelength region. Diffused reflection is obtained by roughening the metal surface or by using a powdered metal. Suitable metals include aluminum, tin, silver, magnesium or alloys thereof. The surface may be made of a metallic plate, foil, or thin film formed by rolling, vacuum evaporation, plating, etc. A support comprising a non-metallic material having formed thereon a metal deposit by vacuum evaporation is preferred. The metallic surface preferably has thereon a water-resistant resin layer, and especially a thermoplastic resin layer. An antistatic layer is preferably provided on the side of the support opposite the metallic surface. The details of such a support having a metallic surface are described, e.g., in JP-A-61-210346, JP-A-63-24247, JP-A-63-24251, and JP-A-63-24255.

The above-described various supports are selected depending on the end use.

The light reflecting substance which can be used in the reflective support preferably includes a white pigment sufficiently kneaded in the presence of a surface active agents. The pigment particles are preferably pre-treated with a di- to tetrahydric alcohol.

The ratio (%) of the area occupied by white pigment particles per unit area is obtained most typically by dividing an observed area into adjacent unit areas each of 6 $\mu m \times 6$ $\mu m$ and determining the ratio of the area (%, $R_i$) occupied by the fine particles projected on each unit area. A coefficient of variation of the area ratio (%) can be calculated from the ratio of a standard deviation (s) of $R_i$ to the average ($\overline{R}$) of $R_i$, i.e., $s/\overline{R}$. The number (n) of unit areas subject to determination is preferably 6 or more. Accordingly, the coefficient of variation $s/\overline{R}$ can be obtained from:

$$\sqrt{\frac{\sum_{i=1}^{n}(R_i - R)^2}{n-1}} \Big/ \frac{\sum_{i=1}^{n} R_i}{n}$$

The pigment fine particles to be used in the present invention preferably have a coefficient of variation ($s/\overline{R}$) of not more than 0.15, and more preferably not more than 0.12. Those particles having a $s/\overline{R}$ of 0.08 or less are considered uniformly dispersed.

The present invention makes it feasible to conduct bleaching in a reduced time while using a bleaching solution which does not cause environmental pollution. Moreover, the present invention provides a method of bleaching a silver halide photographic material to provide an image of satisfactory quality free from stain, blisters, etc. even on continuous running.

The present invention is now illustrated in greater detail by way of the following Examples, but it should be understood that the present invention is not deemed to be limited thereto. Unless otherwise indicated therein, all parts percents, ratios and the like are by weight.

EXAMPLE 1

The layers shown below were coated on a polyethylene-laminated (both sides) paper support in the order listed to prepare a multi-layer color paper. The coating compositions were prepared as follows.

Preparation of First Layer Coating Composition

To a mixture of 19.1 g of a yellow coupler (ExY), 4.4 g of a dye image stabilizer (Cpd-1), and 0.7 g of a dye image stabilizer (Cpd-7) were added 27.2 ml of ethyl acetate and 8.2 g of a solvent (Solv-3) to form a solution. The resulting solution was emulsified and dispersed in 185 ml of a 10% gelatin aqueous solution containing 8 ml of 10% sodium dodecylbenzenesulfonate.

Separately, a cubic silver chlorobromide emulsion having a mean grain size of 0.88 $\mu m$ and a coefficient of variation of size distribution of 0.08 (hereinafter referred to as the larger size emulsion) and a cubic silver chlorobromide emulsion having a mean grain size of 0.70 $\mu m$ and a coefficient of variation of size distribution of 0.10 (hereinafter referred to as the smaller size emulsion), each of which locally contained 0.2 mol % of silver bromide on the grain surface, were prepared. Each of blue-sensitive sensitizing dyes shown below was added to the larger size emulsion in an amount of $2.0 \times 10^{-4}$ mol/mol-Ag and to the smaller size emulsion in an amount of $2.5 \times 10^{-4}$ mol/mol-Ag. The thus spectrally sensitized emulsion was then sulfur sensitized. The finished larger size emulsion and smaller size emulsion were mixed at a ratio of 3:7 (Ag mol ratio; hereinafter the same).

The above-prepared emulsified dispersion and the mixed emulsion were mixed to prepare a First Layer coating composition having the composition shown below.

Coating compositions for Second to Seventh Layers were also prepared in the same manner as the First Layer coating composition.

To each coating composition, 1-hydroxy-3,5-dichloro-s-triazine sodium salt was added as a gelatin hardening agent in an amount of 1.4 wt% to gelatin.

The spectral sensitizing dyes used in each light-sensitive layer and their amounts are shown below.

Blue-Sensitive Emulsion Layer

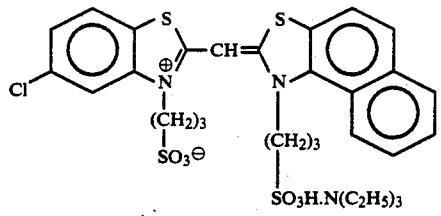

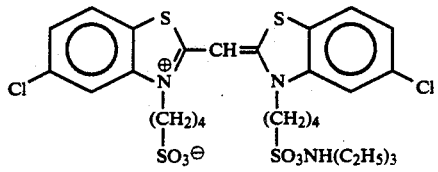

$2.0 \times 10^{-4}$ mol/mol-AgX (X: halogen) to larger size emulsion $2.5 \times 10^{-4}$ mol/mol-AgX to smaller size emulsion Green-Sensitive Emulsion Layer

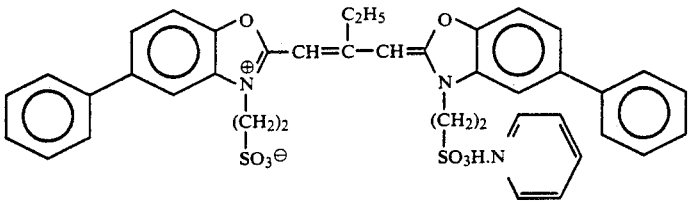

$4.0\times10^{-4}$ mol/mol-AgX to larger size emulsion
$5.6\times10^{-4}$ mol/mol-AgX to smaller size emulsion

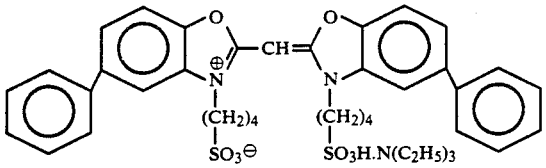

$7.0\times10^{-5}$ mol/mol-AgX to larger size emulsion
$1.0\times10^{-5}$ mol/mol-AgX to smaller size emulsion Red-Sensitive Emulsion Layer

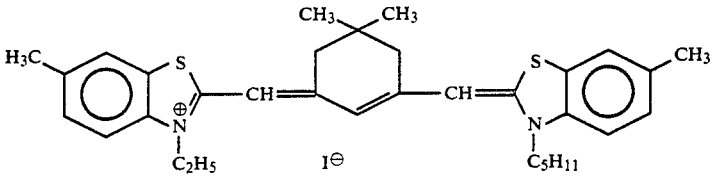

$0.9\times10^{-4}$ mol/mol-AgX to larger size emulsion
$1.1\times10^{-4}$ mol/mol-AgX to smaller size emulsion A compound shown below was further added to the coating composition for a red-sensitive emulsion layer in an amount of $2.6\times10^{-3}$ mol/mol-AgX.

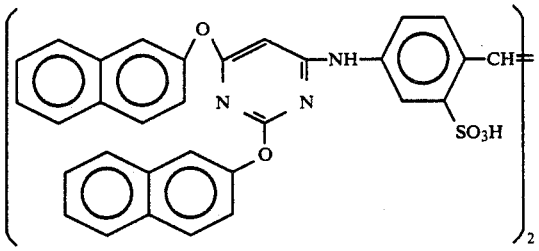

1-(5-Methylureidophenyl)-5-mercaptotetrazole was additionally added to each of the coating compositions for blue-, green- and red-sensitive emulsion layers in an amount of $8.5\times10^{-5}$ mol, $7.7\times10^{-4}$ mol, and $2.5\times10^{-4}$ mol, respectively, per mol of AgX.

To prevent irradiation, the following dyes were added to the emulsion layers.

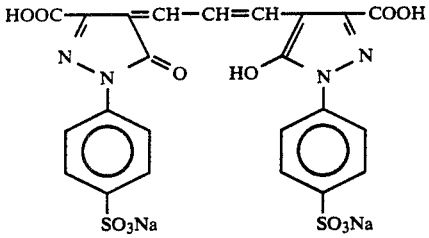

10 mg/m²

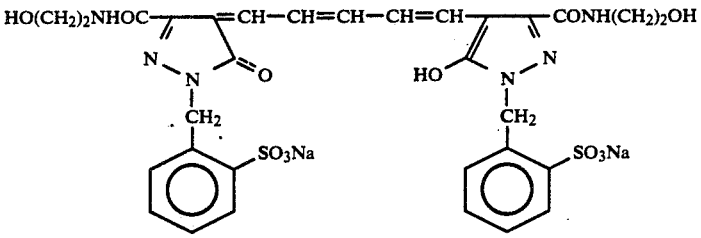

20 mg/m²

The layer structure of the multi-layer color paper is shown below. The amount of a silver halide emulsion is shown in terms of silver coverage (g/m²).

Support:

-continued

| Polyethylene-Laminated Paper (the polyethylene layer on the side to be coated with the First Layer contained 14.7 wt % of a white pigment ($TiO_2$) and 0.3 wt % of a bluing dye (ultramarine)). | Amount ($g/m^2$) |
|---|---|
| First Layer (Blue-Sensitive Layer): | |
| The Above-Described Silver Chlorobromide Emulsion | 0.30 |
| Gelatin | 1.49 |
| Yellow Coupler (ExY) | 0.82 |
| Dye Image Stabilizer (Cpd-1) | 0.19 |
| Solvent (Solv-3) | 0.28 |
| Dye Image Stabilizer (Cpd-7) | 0.06 |
| Second Layer (Color Mixing Preventive Layer): | |
| Gelatin | 0.69 |
| Color Mixing Inhibitor (Cpd-5) | 0.08 |
| Solvent (Solv-1) | 0.11 |
| Solvent (Solv-4) | 0.05 |
| Third Layer (Green-Sensitive Layer): | |
| Silver Chlorobromide Emulsion (cubic grains; a 1:3 mixture in molar ratio of an emulsion having a mean grain size of 0.55 μm and a coefficient of variation of size distribution of 0.10 and an emulsion having a mean grain size of 0.39 μm and a coefficient of variation of size distribution of 0.08, each locally containing 0.8 mol % of AgBr on the grain surface) | 0.12 |
| Gelatin | 0.99 |
| Magenta Coupler (ExM) | 0.20 |
| Dye Image Stabilizer (Cpd-2) | 0.03 |
| Dye Image Stabilizer (Cpd-3) | 0.15 |
| Dye Image Stabilizer (Cpd-4) | 0.02 |
| Dye Image Stabilizer (Cpd-9) | 0.02 |
| Solvent (Solv-2) | 0.32 |

-continued

| | |
|---|---|
| Fourth Layer (Ultraviolet Absorbing Layer): | |
| Gelatin | 1.1 |
| Ultraviolet Absorbent (UV-1) | 0.38 |
| Color Mixing Inhibitor (Cpd-5) | 0.05 |
| Solvent (Solv-5) | 0.19 |
| Fifth Layer (Red-Sensitive Layer): | |
| Silver chlorobromide emulsion (cubic grains; a 1:4 mixture in molar ratio of an emulsion having a mean grain size of 0.58 m and a coefficient of variation of size distribution of 0.09 and an emulsion having a mean grain size of 0.45 m and a coefficient of variation of size distribution of 0.11, each locally containing 0.6 mol % of AgBr on the grain surface) | 0.23 |
| Gelatin | 1.10 |
| Cyan Coupler (ExC) | 0.32 |
| Dye Image Stabilizer (Cpd-6) | 0.17 |
| Dye Image Stabilizer (Cpd-7) | 0.40 |
| Dye Image Stabilizer (Cpd-8) | 0.04 |
| Solvent (Solv-6) | 0.14 |
| Sixth Layer (Ultraviolet Absorbic Layer): | |
| Gelatin | 0.37 |
| Ultraviolet Absorbent (UV-1) | 0.13 |
| Color Mixing Inhibitor (Cpd-5) | 0.02 |
| Solvent (Solv-5) | 0.06 |
| Seventh Layer (Protective Layer): | |
| Gelatin | 1.00 |
| Acryl-Modified Copolymer of Polyvinyl Alcohol (degree of modification: 17%) | 0.17 |
| Liquid Paraffin | 0.03 |

The couplers and other photographic additives used above are shown below.

Yellow Coupler (ExY):

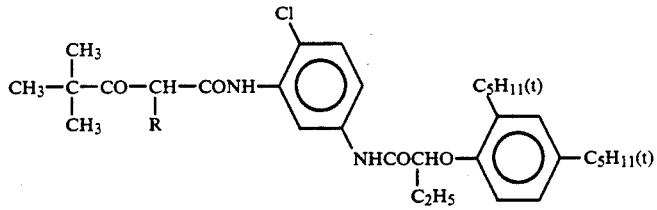

(wherein R:

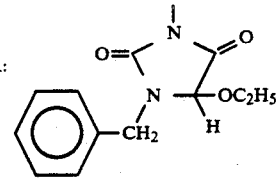

and

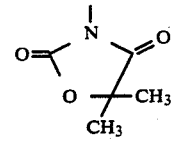

= 1:1 by mol)

Magenta Coupler (ExM):
1:1 (by mol) mixture of:

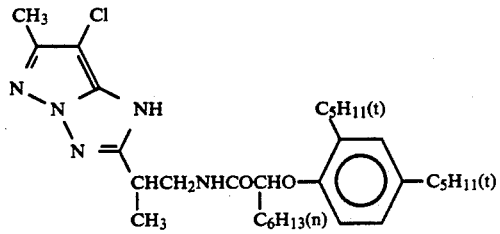

and

-continued
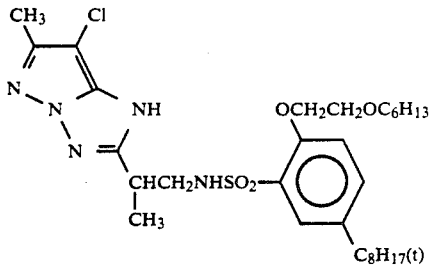
Cyan Coupler (ExC):
2:4:4 (by weight) mixture of:
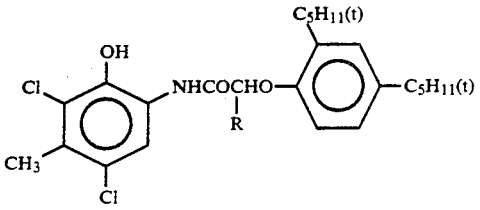
(wherein R: $C_2H_5$ and $C_4H_9$)
and
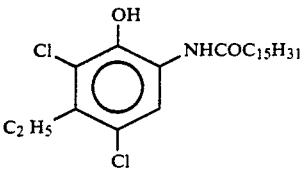
Dye Image Stabilizer (Cpd-1):
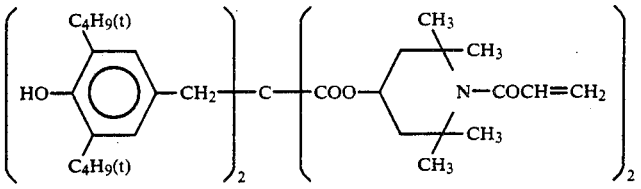
Dye Image Stabilizer (Cpd-2):
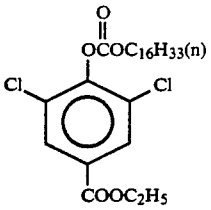
Dye Image Stabilizer (Cpd-3):
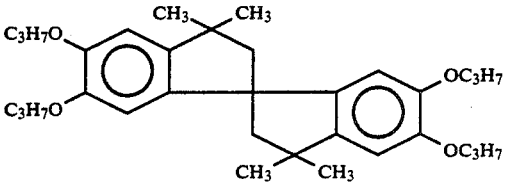
Dye Image Stabilizer (Cpd-4):

-continued
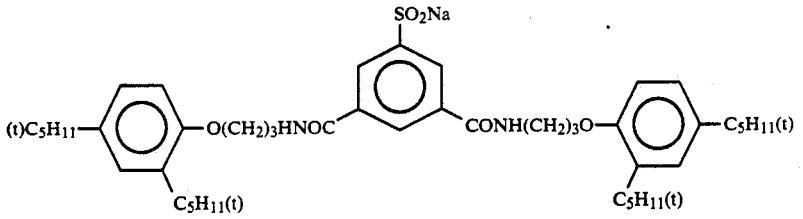
Color Mixing Inhibitor (Cpd-5):
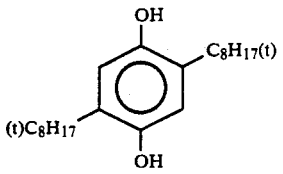
Dye Image Stabilizer (Cpd-6):
2:4:4 (by weight) mixture of:
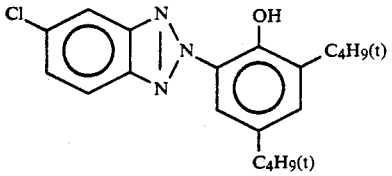
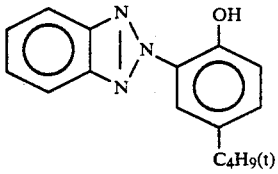
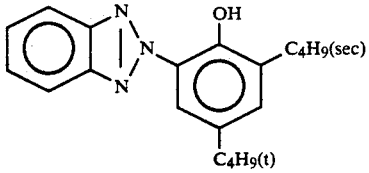
Dye Image Stabilizer (Cpd-7):
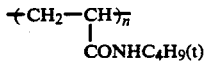
(Average Molecular Weight: 60,000)
Dye Image Stabilizer (Cpd-8):
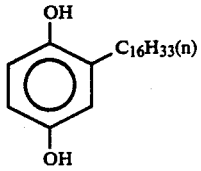
Dye Image Stabilizer (Cpd-9):

-continued
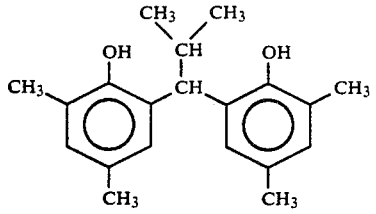
Ultraviolet Absorbent (UV-1):
4:2:4 (by weight) mixture of:
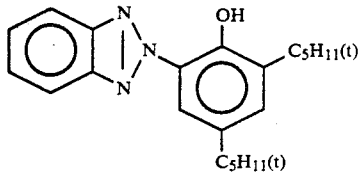
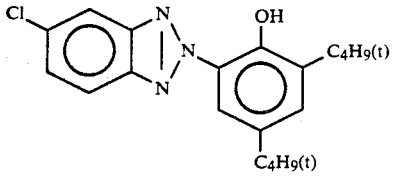
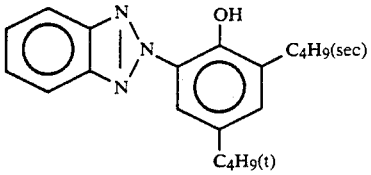
Solvent (Solv-1):
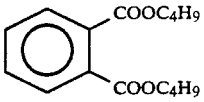
Solvent (Solv-2):
2:1 (by volume) mixture of:
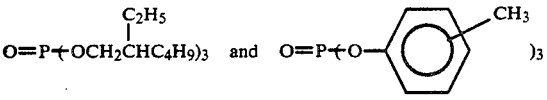
Solvent (Solv-3):
$O{=}P{\leftarrow}O{-}C_9H_{19}(iso)_3$
Solvent (Solv-4):
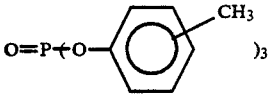
Solvent (Solv-5):
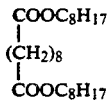
Solvent (Solv-6):

-continued

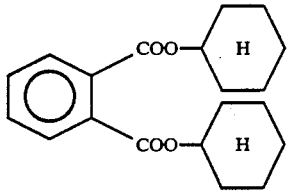

Each of the thus prepared samples was imagewise exposed to light through an optical wedge for sensitometry using a sensitometer ("FWH Model" manufactured by Fuji Photo Film Co., Ltd.; light source color temperature: 3200° K.) for 0.1 second in an exposure amount of 250 CMS.

Each exposed sample was processed according to the following schedule using processing solution shaving the following compositions, with the kind of a color developing agent being altered as shown in Table 1 below to vary the uptake of developing agent into the development processed film.

| Processing Step | Temperature | Time |
|---|---|---|
| Color Development | 40° C. | 15 sec |
| Bleach-fix | 35–40° C. | 15 sec |
| Washing | 30–40° C. | 15 sec |
| Stabilization | 30–40° C. | 15 sec |
| Drying | 50–80° C. | 30 sec |

| Color Developer: | |
|---|---|
| Water | 800 ml |
| Ethylenediamine-N,N,N,N-tetramethylene-phosphonic Acid | 2.0 g |
| Triethanolamine | 8.0 g |
| Potassium Bromide | 15 mg |
| Sodium Chloride | 1.4 g |
| Potassium Carbonate | 20 g |
| Sodium Hydrogen Carbonate | 4.0 g |
| Fluorescent Brightening Agent ("WHITEX 4B" produced by Sumitomo Chemical Co., Ltd.) | 1.0 g |
| Diethylhydroxylamine (80% aqueous solution) | 6.3 g |
| Sodium Sulfite | 0.1 g |
| Color Developing Agent (see Table 1) | 22 mmol |
| Water to make | 1000 ml |
| pH (25° C.) | 10.05 |
| Bleach-Fix Bath: | |
| (The running solution and the replenisher had the same composition.) | |
| Water | 400 ml |

-continued

| | |
|---|---|
| Ammonium Thiosulfate (70% aq. soln.) | 100 ml |
| Sodium Sulfite | 17 g |
| Ammonium (Ethylenediaminetetraacetato)iron (III) | 55 g |
| Disodium Ethylenediaminetetraacetate | 5 g |
| Ammonium Bromide | 40 g |
| Water to make | 1000 ml |
| pH (25° C.) | 6.0 |
| Washing Water: | |
| Tap Water | |
| Stabilizing Bath: | |
| 5-Chloro-2-methyl-4-isothiazolin-3-one | 0.02 g |
| 2-Methyl-4-isothiazolin-3-one | 0.01 g |
| Hydroxyethylidene-1,1-diphosphonic Acid (60% aq. soln.) | 12 g |
| Water to make | 1000 ml |
| pH (25° C.) | 4.0–7.0 |

TABLE 1

Color Developing Agent p-Toluenesulfonate of

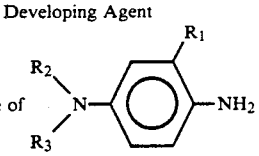

| Sample No. | $R_1$ | $R_2$ | $R_3$ | logP (calcd.) | Remark |
|---|---|---|---|---|---|
| 1 | $CH_3$ | $C_2H_5$ | $C_2H_5$ | 1.933 | Comparison |
| 2 | " | " | $C_2H_4OCH_3$ | 1.526 | " |
| 3 | $OCH_3$ | " | $C_2H_5$ | 1.452 | " |
| 4 | $CH_3$ | $C_2H_4OCH_3$ | $C_2H_4OCH_3$ | 1.391 | " |
| 5 | $NHCO_2CH_3$ | $C_2H_5$ | $C_2H_5$ | 0.903 | " |
| 6 | $C_2H_4OH$ | " | " | 0.942 | Invention |
| 7 | $CH_3$ | " | $C_2H_4NHSO_2CH_3$ | 0.869 | " |
| 8 | " | " | $C_3H_6OH$ | 0.848 | " |
| 9 | " | " | $C_2H_4OC_2H_4OH$ | 0.766 | " |

The minimum and maximum densities ($D_{min}D_{max}$) for each of yellow, magenta and cyan dyes of the resulting image were measured through a B, G, or R filter, respectively. Then, the processed samples were exposed to xenon light (300,000 lux) for 8 days in a room at a relative humidity of 70%, and the increase in minimum density ($^{\Delta}D_B$) due to light irradiation was determined.

The residual silver amount in the maximum density area of the processed sample was analyzed using a fluorescent X-ray method. A reflection micrograph of the image was taken to determine minute bleach unevenness (unevenness of residual silver) arising from desilvering insufficiency.

The amount (uptake) of the color developing agent present in the sample after color development was determined by extracting the residual color developing agent into acetic acid and ethyl acetate after removal of any liquid on the film.

The results obtained are shown in Table 2 below.

TABLE 2

| Sample No. | Uptake of Color Developing Agent in Film After Color Development (mmol/m²) | $D_{max}$ B | $D_{max}$ G | $D_{max}$ R | $D_{min}$ B | $D_{min}$ G | $D_{min}$ R | $\Delta D_B$ | Residual Silver Amount (mg/m²) | Bleach Unevenness | Remark |
|---|---|---|---|---|---|---|---|---|---|---|---|
| 1 | 2.53 | 0.48 | 2.05 | 2.40 | 0.08 | 0.06 | 0.12 | 0.18 | 25 | greatly observed | Comparison |
| 2 | 1.54 | 0.25 | 2.35 | 2.48 | 0.09 | 0.06 | 0.12 | 0.16 | 15 | observed | " |
| 3 | 1.98 | 0.95 | 2.50 | 2.05 | 0.09 | 0.07 | 0.12 | 0.17 | 20 | greatly observed | " |
| 4 | 1.77 | 0.20 | 2.30 | 2.48 | 0.09 | 0.06 | 0.12 | 0.17 | 15 | observed | " |
| 5 | 1.40 | 1.05 | 2.55 | 2.65 | 0.08 | 0.06 | 0.12 | 0.16 | 15 | slightly observed | " |
| 6 | 0.58 | 2.13 | 2.45 | 2.45 | 0.10 | 0.07 | 0.12 | 0.04 | 5 or less | not observed | Invention |
| 7 | 0.74 | 1.98 | 2.30 | 2.48 | 0.10 | 0.07 | 0.12 | 0.08 | 8 | not observed | " |
| 8 | 0.60 | 2.18 | 2.50 | 2.45 | 0.10 | 0.08 | 0.13 | 0.04 | 5 or less | not observed | " |
| 9 | 0.53 | 2.15 | 2.50 | 2.45 | 0.10 | 0.08 | 0.13 | 0.04 | 5 or less | not observed | " |

As shown by the results in Table 2, the amount of color developing agent in the light-sensitive material after color development varied depending on the structure of the p-phenylenediamine derivative. It can be seen from the results that when the light-sensitive material is subjected to bleach-fix and then washing with the uptake of the color developing agent being controlled below 1.0 mmol/m², the resulting processed sample contains substantially no residual silver and bleach unevenness while suppressing light stain did not arise. Further reducing the color developing agent uptake to 0.6 mmol/m² or less brings about further improvements. Reduction of this uptake to 1.0 mmol/m² also turns out to be effective for achieving rapid development.

EXAMPLE 2

The effect produced when the swell characteristics of a light-sensitive material are varied by changing the amounts of the binder (i.e., gelatin) and the hardening agent to control uptake of the color developing agent into the light-sensitive material were evaluated.

A multi-layer color paper was prepared in the same manner as for Sample 8 of Example 1, except that the amount of the gelatin hardening agent, 1-hydroxy-3,5-dichloro-s-triazine sodium salt, was varied to have a swollen film thickness as shown in Table 3 below due to a developing solution having the following composition for 15 seconds.

The resulting sample was exposed to light in the same manner as in Example 1, and the exposed sample was continuously processed (running test) according to the following schedule using processing solutions shown below until the amount of the color developing replenisher reached the volume corresponding to the tank volume.

| Processing Step | Temp. (°C.) | Time (sec) | Rate of Replenishment (ml/m²) | Tank Volume (l) |
|---|---|---|---|---|
| Color Development | 35 | 15 | 60 | 2 |
| Bleach-Fix | 30–35 | 15 | 60 | 2 |
| Rinsing (1) | 30–35 | 10 | — | 1 |
| Rinsing (2) | 30–35 | 10 | — | 1 |
| Rinsing (3) | 30–35 | 10 | 120 | 1 |
| Drying | 70–80° C. | 20 | | |

Rinsing was carried out in a 3-tank counter-current system of from (3) toward (1).

-continued

| | Running Solution | Replenisher |
|---|---|---|
| Color Developing agent: | | |
| Water | 800 ml | 800 ml |
| Ethylenediamine-N,N,N,N-tetramethylenephosphonic Acid | 1.5 g | 2.0 g |
| Potassium Bromide | 0.015 g | — |
| Triethanolamine | 8.0 g | 12.0 g |
| Sodium Chloride | 4.9 g | — |
| Potassium Carbonate | 25 g | 37 g |
| Color Developing Agent (the same as in Sample 8 of Table 1) | 12.8 g | 19.8 g |
| N,N-bis(Carboxymethyl)hydrazine | 5.5 g | 7.0 g |
| Fluorescent Brightening Agent ("WHITEX" produced by Sumitomo Chemical Co., Ltd.) | 1.0 g | 2.0 g |
| Water to make | 1000 ml | 1000 ml |
| pH (25° C.) | 10.05 | 10.45 |
| Bleach-Fix Bath: | | |
| (The running solution and the replenisher had the same composition.) | | |
| Water | | 400 ml |
| Ammonium Thiosulfate (70% aq. soln.) | | 100 ml |
| Sodium Nitrate | | 17 g |
| Ammonium (Ethylenediaminetetraacetato)iron (III) | | 55 g |
| Disodium Ethylenediaminetetraacetate | | 5 g |
| Ammonium Bromide | | 40 g |
| Water to make | | 1000 ml |
| pH (25° C.) | | 6.0 |
| Rinsing Solution: | | |
| (The running solution and the replenisher had the same composition.) | | |

Ion-exchanged water with calcium and magnesium ion content of 3 ppm or less.

Each of the color developing solution, bleach-fix solution and rinsing solution was replenished at a rate of 120 ml per m² of the light-sensitive material.

Rinsing was carried out in a 3-stage counterflow system in which the overflow was made to flow from the final third tank to the first tank.

The samples obtained by processing at the start and the end of the running test were subjected to sensitometry, and the amount of residual silver in the maximum density area after drying was measured in the same manner as in Example 1. Then, the processed samples were exposed to xenon light (300,000 lux) for 8 days in a room at a relative humidity of 70%, and the increase in minimum density ($\Delta D_B$) due to light irradiation was determined. The results obtained are shown in Table 3 below.

TABLE 3

| Sample No. | Swollen Film Thickness (μm) | Uptake of Color Developing Agent in Film (mmol/m²) | $\Delta D_8$ Start | $\Delta D_8$ End | Residual Silver Amount Start | Residual Silver Amount End | Remark |
|---|---|---|---|---|---|---|---|
| 11 | 40 | 1.44 | 0.12 | 0.17 | 13 | 18 | Comparison |
| 12 | 30 | 1.25 | 0.11 | 0.15 | 12 | 16 | " |
| 13 | 20 | 0.83 | 0.07 | 0.07 | 8 | 8 | Invention |
| 14 | 15 | 0.65 | 0.05 | 0.05 | 5 or less | 5 or less | " |
| 15 | 10 | 0.37 | 0.03 | 0.04 | 5 or less | 5 or less | " |

It can be seen from the results in Table 3 that when a color development processed light-sensitive material containing more than 1 mmol/m² of a color developing agent is subjected to desilvering, desilvering insufficiency occurs, and the resulting image is deteriorated due to light stain. Preferably the light-sensitive material to be processed according to the present invention has a swollen film thickness of not more than 20 μm.

Thus, the process of the present invention provides an image of sufficient quality having a reduced amount of residual silver and where light stain either at the start or at the end of continuous processing even with a reduced amount of replenishers does not occur.

While the invention has been described in detail and with reference to specific embodiments thereof, it will be apparent to one skilled in the art that various changes and modifications can be made therein without departing from the spirit and scope thereof.

What is claimed is:

1. A method for processing a silver halide light-sensitive material comprising subjecting an imagewise exposed silver halide color light-sensitive material having a silver chloride content substantially of 90 mol % or more to color development in a color developing solution containing a hydrophilic p-phenylenediamine derivative and substantially no benzyl alcohol at a temperature of 30° C. or higher for a period of 15 seconds or less and then subjecting the color developed material to bleach or bleach-fix, wherein the color development processed silver halide color light-sensitive material is introduced into a bleaching or bleach-fix bath with the amount of a color developing agent in the film of the light-sensitive material being controlled to 0.8 mmol/m² or less, and wherein the desilvering is completed within 30 seconds.

2. A method as claimed in claim 1, wherein said hydrophilic p-phenylenediamine derivative is represented by formula (I):

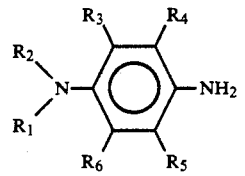

(I)

wherein $R_1$ and $R_2$ each represents a substituted or unsubstituted alkyl group; and $R_3$, $R_4$, $R_5$, and $R_6$ each represents a hydrogen atom, a substituted or unsubstituted alkyl group, a substituted or unsubstituted alkoxy group, a sulfo group, or a carboxyl group; or $R_1$ and $R_2$ combine to form a 5- to 7-membered nitrogen-containing heterocyclic ring; and at least one of $R_1$, $R_2$, $R_3$, $R_4$, $R_5$, and $R_6$ represents a substituted alkyl or alkoxy group containing a water solubility imparting group.

3. A method as claimed in claim 2, wherein said hydrophilic p-phenylenediamine derivative has a logP value of 1.0 or less.

4. A method as claimed in claim 1, wherein the process comprises introducing the color development processed silver halide color light-sensitive material into a bleaching or bleach-fix bath with the amount of a color developing agent in the film of the light-sensitive material being controlled to 0.3 to 0.6 mmol/m².

5. A method as claimed in claim 1, wherein the process comprises replenishing said color developing solution at a rate of 60 ml or less per m² of the light-sensitive material, and the amount of the replenisher to the bleach-fix bath or the washing solution is 3 times or less the carry-over from the respective prebath per unit area of the light-sensitive material.

6. A method as claimed in claim 1, wherein the concentration of benzyl alcohol in the color developing solution is not more than 8 ml/l.

7. A method as claimed in claim 1, wherein the concentration of benzyl alcohol in the color developing solution is from 0 up to 3 ml/l.

8. A method as claimed in claim 1, wherein the swollen film thickness of the light-sensitive material is 20 μm or less.

9. A method as claimed in claim 1, wherein the amount of color developing solution replenisher is from 15 to 60 ml per m² of the light-sensitive material.

* * * * *